US007832153B2

(12) United States Patent
Crookston

(10) Patent No.: US 7,832,153 B2
(45) **Date of Patent: *Nov. 16, 2010**

(54) TRUSS GUSSET PLATE AND ANCHOR SAFETY SYSTEM

(76) Inventor: Lawrence A. Crookston, 250 S. VanBuren Ave., Barberton, OH (US) 44203

( * ) Notice: Subject to any disclaimer, the term of this patent is extended or adjusted under 35 U.S.C. 154(b) by 0 days.

This patent is subject to a terminal disclaimer.

(21) Appl. No.: 12/504,305

(22) Filed: Jul. 16, 2009

(65) Prior Publication Data

US 2009/0272064 A1 Nov. 5, 2009

Related U.S. Application Data

(63) Continuation-in-part of application No. 12/100,122, filed on Apr. 9, 2008, which is a continuation-in-part of application No. 11/069,819, filed on Mar. 1, 2005, now Pat. No. 7,380,373.

(51) Int. Cl.
*E04B 1/38* (2006.01)

(52) U.S. Cl. ..... 52/127.5; 52/749.12; 52/92.2; 52/712; 182/45

(58) Field of Classification Search ..... 52/641, 52/645, 695, 633, 634, 635, 638, 749.12, 52/745.21, 127.5, 698, 92.2, 93.1, 712; 182/3, 182/45; 411/461–468
See application file for complete search history.

(56) References Cited

U.S. PATENT DOCUMENTS 3,162,719 A 12/1964 Mulford
3,423,898 A 1/1969 Tracy et al.
3,703,304 A 11/1972 Losee
3,708,942 A * 1/1973 Leonard ..... 52/694
4,910,934 A 3/1990 Hennings
4,946,123 A 8/1990 Albert
5,137,112 A 8/1992 Nichols
5,143,171 A 9/1992 Glynn et al.
5,165,642 A 11/1992 Rihaly (Continued)

FOREIGN PATENT DOCUMENTS

GB 2251020 6/1992

(Continued)

OTHER PUBLICATIONS

Super Anchor Safety, Fall Protection Equipment, Full Line Catalog, 2004, 28 pages.

*Primary Examiner*—Richard E Chilcot, Jr.
*Assistant Examiner*—Chi Nguyen
(74) *Attorney, Agent, or Firm*—Sand & Sebolt

(57) ABSTRACT

A gusset connector plate for anchoring a safety line to a roof truss, a roof truss and an anchoring system incorporating the same. The plate is substantially planar and includes an attachment region and an anchor portion. Teeth extend from the attachment region and into the sides of truss members that form the peak of the roof truss. The anchor portion extends laterally beneath the peak and a hole defined therein receives the connector for the security line. The hole is disposed below the lower surfaces of the truss members and vertically beneath the peak. The plate is permanently engaged with the truss. A single plate or a pair of plates may be incorporated in the roof truss and utilized in the anchoring system.

23 Claims, 41 Drawing Sheets

U.S. PATENT DOCUMENTS

| | | | | |
|---|---|---|---|---|
| 5,248,021 | A | 9/1993 | Nichols | |
| 5,282,597 | A | 2/1994 | Babcock | |
| 5,287,944 | A | 2/1994 | Woodyard | |
| 5,346,036 | A | 9/1994 | Arisman et al. | |
| 5,361,558 | A | 11/1994 | Thornton et al. | |
| 5,370,202 | A | 12/1994 | Nichols | |
| 5,553,685 | A | 9/1996 | Cook | |
| 5,558,312 | A | 9/1996 | Brennan | |
| 5,595,260 | A | 1/1997 | Jalla | |
| 5,687,535 | A | 11/1997 | Rohlf | |
| 5,727,646 | A | 3/1998 | Gray | |
| 5,730,407 | A | 3/1998 | Ostrobrod | |
| 5,850,889 | A | 12/1998 | Rexroad et al. | |
| 5,896,719 | A | 4/1999 | Thornton | |
| 6,098,746 | A | 8/2000 | Castaneda | |
| 6,241,205 | B1 | 6/2001 | Affrunti | |
| 6,691,826 | B1 | 2/2004 | Dean | |
| 6,705,018 | B2 | 3/2004 | Guhse | |
| 6,779,316 | B2 | 8/2004 | Carroll | |
| 6,786,020 | B2 | 9/2004 | Poldmaa | |
| 6,877,291 | B2 | 4/2005 | Shamroukh et al. | |
| 6,966,531 | B2 | 11/2005 | Curtin | |
| 7,380,373 | B2 * | 6/2008 | Crookston | 52/127.5 |
| 2003/0051429 | A1 | 3/2003 | Hovenier | |

FOREIGN PATENT DOCUMENTS

| | | |
|---|---|---|
| GB | 2291100 | 1/1996 |
| GB | 2397845 | 8/2004 |

* cited by examiner

TRUSS GUSSET PLATE AND ANCHOR SAFETY SYSTEM

CROSS-REFERENCE TO RELATED APPLICATIONS

This is a Continuation-in-Part of U.S. patent application Ser. No. 12/100,122, filed Apr. 9, 2008, which is a Continuation-in-Part of U.S. patent application Ser. No. 11/069,819, filed Mar. 1, 2005, now U.S. Pat. No. 7,380,373.

TECHNICAL FIELD

This invention relates to a roof truss connector plate and roof anchor safety system and, in particular, to a connector plate having an anchor portion extending downwardly therefrom that allows components of the roof anchor system to be secured to a roof truss. The truss connector plates are factory installed when the roof truss is formed and provide certifiable anchor capacity to the user.

BACKGROUND OF THE INVENTION

The need for securing roofing roofers on pitched roofs is well known and is now being required by many government regulations. Many safety systems have been developed to secure roofers, with the majority involving an anchor attached to either a rafter of a truss or to the surface of the roof. These prior art anchor systems may be temporary or permanent.

A problem with these prior art systems is that they rely on a roofing roofer to initially attach the anchor. This often can result in the anchor being attached incorrectly. The potential misconnection of anchor bolts, screws and brackets, and the resulting personal injury, is a serious problem with the prior art safety systems. Additionally, due to the potential liability, building contractors many times retain independent sub-contractors that are expected to provide proper protection, but many times fail to do so. The difficulty and potential for improper installation lead to disastrous results if a roof roofer should fall, and the need therefore exists for a simple, integrated approach to provide roof safety to every construction site.

Accordingly, there is a need for providing a roof anchor system that overcomes problems associated with the prior art.

SUMMARY OF THE INVENTION

The present invention comprises a gusset connector plate for anchoring a safety line to a roof truss, a roof truss and an anchoring system incorporating the same. The plate is substantially planar and includes an attachment region and an anchor portion. Teeth extend from the attachment region and into the sides of truss members that form the peak of the roof truss. The anchor portion extends laterally beneath the peak and a hole defined therein receives a connector for the security line. The hole is disposed below the lower surfaces of the truss members and vertically beneath the peak. The plate is permanently engaged with the truss. A single plate or a pair of plates may be incorporated in the roof truss and utilized in the anchoring system.

BRIEF DESCRIPTION OF THE DRAWINGS

This invention will now be described in further detail with reference to the accompanying drawings, in which.

DETAILED DESCRIPTION OF THE INVENTION

Figure 1B:
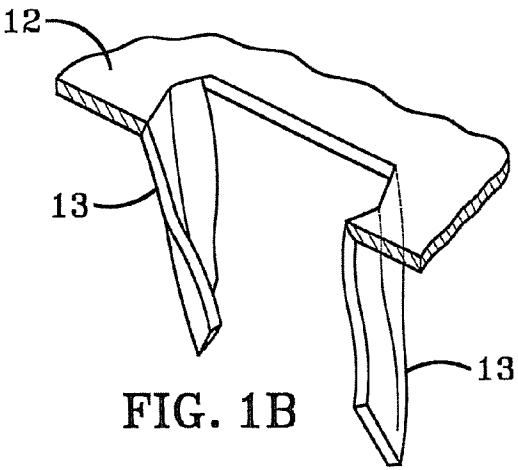
FIG. 1A is a front view of a peak gusset of a roof anchor system of the present invention and FIG. 1B is a detail perspective view of one of the plurality of teeth of the peak gusset of FIG. 1A.
Figure 1A:
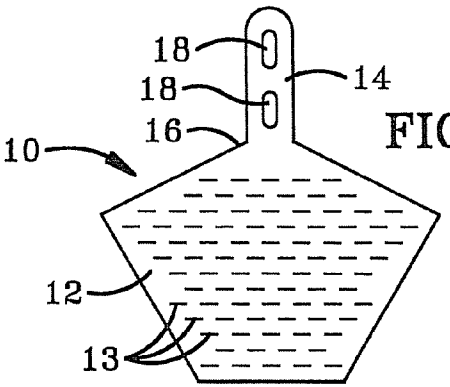

The present invention is directed to an integrated roof safety system wherein successful attachment of this device is assured because it is designed to be installed under ideal and regulated factory conditions. The provision of this device, by the general building contractor, for use by the various hired subsequent subtrades, will create a safe workplace and cause more compliance with existing government regulations. The result will be practical, economical and failsafe product and system. The roof anchor safety system 110 of the present invention will now be described in detail with reference to various embodiments thereof. Referring now to FIG. 1A, a truss connector plate 10 for use at the peak of a truss and referred to herein as a peak gusset 10 is shown and comprises the primary component of the roof anchor safety system 110. The peak gusset 10 comprises a plate 12 of steel having a plurality of teeth 13 formed from the plate 12 and extending perpendicularly from the plate 12 as best shown in FIG. 1B. Referring back to FIG. 1A, the exact shape of the plate being unimportant, it is only necessary that the plate be of sufficient size and geometry to resist anticipated pull forces. The peak gusset 10 further comprises an anchor portion 14 extending from the peak side 16 of the gusset 10. The peak gusset 10 is monolithic such that the anchor portion 14 is an extension of the plate 12. The anchor portion 14 includes a means for attachment 18 of other safety items, the attachment means shown herein as a pair of apertures 18 in the form of a slot 18. It is noted that other attachment means are contemplate such as an open slot for engaging a stud of the type used for bayonet connection, or other known connection devices. The thickness of the gusset 10 may be of a standard gusset thickness, typically 16-20 gauge, or may be made of a thicker gauge for added strength.

Figure 2:
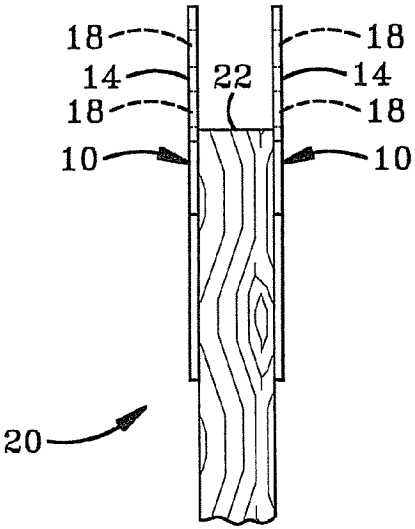
FIG. 2 is a side view of a pair of peak gussets, as shown in FIG. 1, attached to a truss rafter.

A peak gusset 10 is attached to either side of a truss peak 22 as shown in FIG. 2. The plurality of teeth (not shown) is pressed into the wooden truss peak 22 during manufacture of the truss 20 typically using a roll or hydraulic press. Manufacture of the truss is accomplished at the factory under standard environmental conditions to control the quality and strength of the truss. The anchor portion 14 extends outward from the truss peak 22. At lease one aperture 18 provides a connection location for other elements of the roof anchor safety system 110. Although not shown, it is contemplated that the anchor portion 14 can be formed with vertically extending ribs in a pressed single or multiple wave or corrugated type configuration to add additional strength to the anchor portion 14 of the gusset 10. Between the manufacture and installation f the truss 20, the anchor portion 14 may be covered with a protective coating or covering (not shown) such as foam wrap or the like in order to protect the anchor portion 14 as well as roofer handing the truss 20. A wooden piece of strap material may also be inserted between the anchor portions 14 and temporarily secured to provide additional protection against bending or other damage to the anchor portions 14 during handling and transportation.

Figure 3:
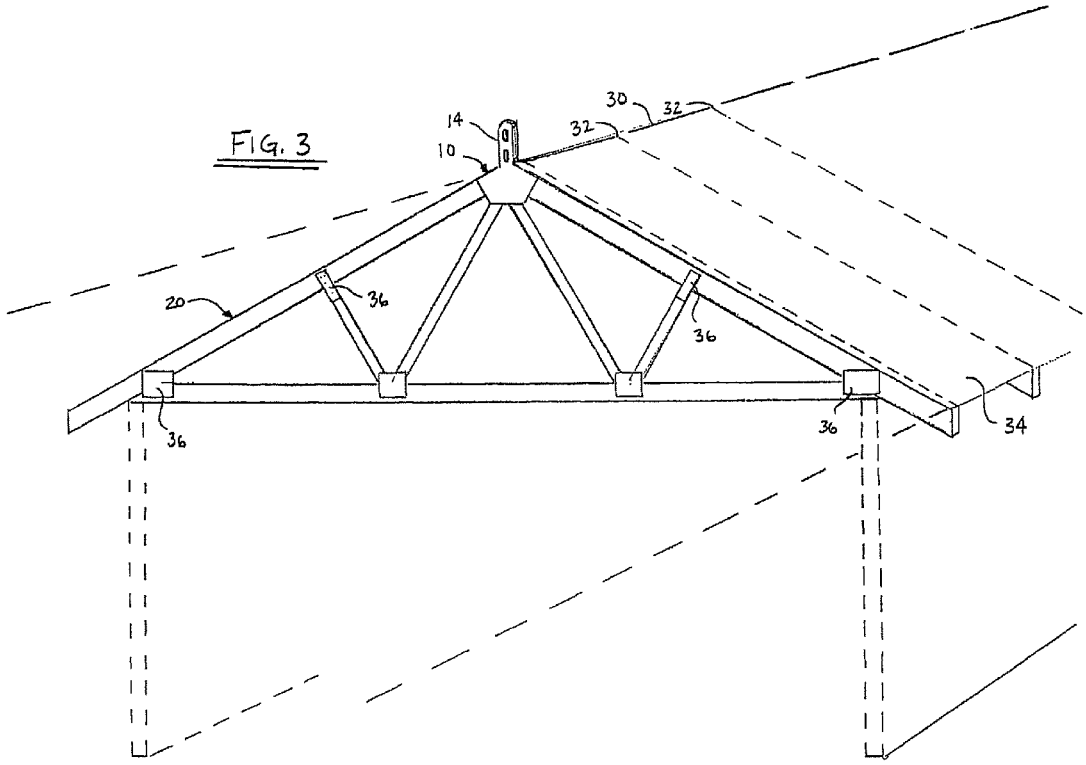
FIG. 3 is a perspective view of a truss formed with the peak gussets of FIG. 1 and shown with a building structure generally shown in phantom.

The resulting truss 20 is shown in FIG. 3 with the peak gusset 10 positioned such that the anchor portion 14 of the gusset 10 extends upward from a ridge line 30 formed by the other truss peaks 32 of the roof 34 (shown in phantom). The anchor portion 14 provides an attachment location for D-rings, hooks, cables, and other means of securing a person while working on the roof 34. It is important to note that, although the peak gusset 10 is shown in the present disclosure solely at the peak of a truss 20, it is contemplate that the other truss connection plates 36 could be configured with an anchor portion as well.

Figure 4:
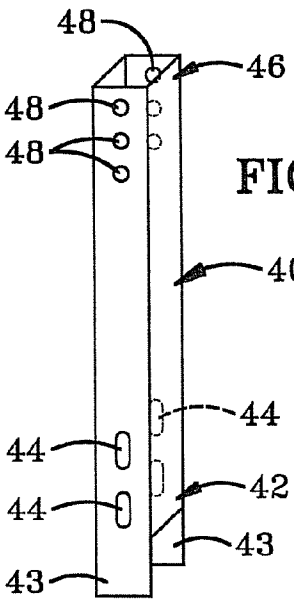
FIG. 4 is a perspective view of a high reach accessory of the roof anchor system of the present invention.

The roof anchor system 110 of the present invention further comprises an anchor extension member 40 referred to as a high reach accessory 40 as shown in FIG. 4. The high reach accessory 40 is essentially an extension bar of a predetermined length that attaches at a first end 42 to the peak gusset 10. The first end 42 may also include sidewall extensions 43 that extend over the sides of the truss peak 22 to provide additional stability and prevent low-impact side-to-side collapse of the anchor portions 14 of the gussets 10. The first end 42 fits over the anchor portions 14 and includes an attachment means 44 for securing the high reach accessory 40 to the anchor portions 14 herein shown as apertures 44 in the form of slots 44. The opposite end 46 of the high reach accessory 40 includes attachment means 48 for attachment of other safety items, the attachment means 48 shown herein as a plurality of apertures 48.

Figure 5:
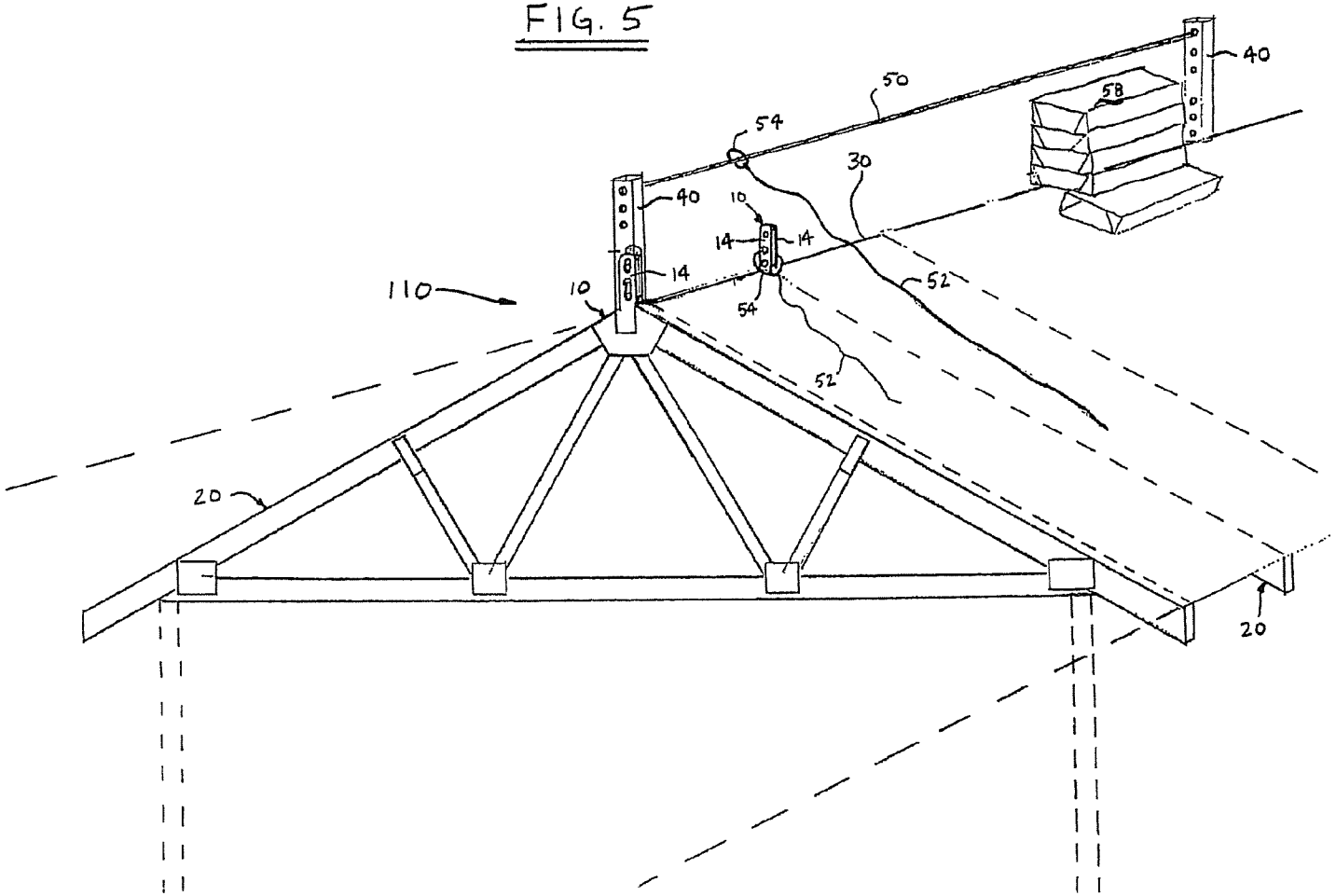
FIG. 5 is a perspective view of a roof having the roof anchor system of the present invention attached thereto.

The roof anchor safety system 110 of the present invention is shown in FIG. 5. A truss 20 is shown having peak gussets 10 attached thereto. A high reach accessory 40 is shown attached over the anchor portion 14 (shown as visible even though covered) of the peak gussets 10. A second high reach accessory 40 is attached to a second peak gusset (not shown) further down the ridge line 30. A tether line 40 is attached to and extends between the high reach accessories 40. A harness line 52 is shown slidably attached to the tether line 50 by an attachment ring 54. An additional truss 20 is shown having peak gussets 10 and is positioned between the two high reach accessories 40. A harness line 52 is shown attached to the anchor portions 14 of the peak gussets 10 by an attachment ring 54. Squares of shingles 58 are shown positioned along the ridge line 30.

Figure 6:
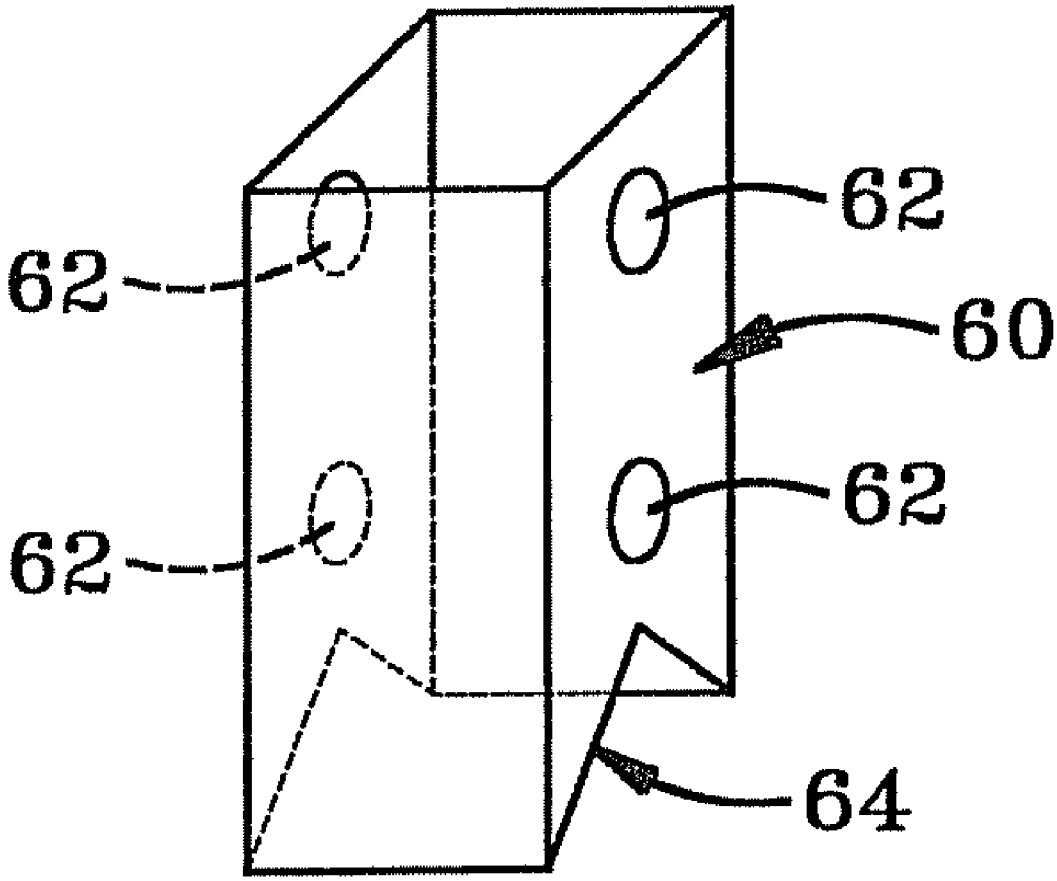
FIG. 6 is a perspective view of a support ferrule insert of the roof anchor system of the present invention.

FIG. 6, a support ferrule insert is shown for insertion between the anchor portions 14 of the gussets 10 to provide additional support and strength to the anchor portions 14. The support ferrule 60 includes apertures 62. The support ferrule 60 is shown as a tubular member or it may be a solid block. The support ferrule 60 is positioned prior to attachment of the high reach accessory 40. The support ferrule 60 may also include a first end 64 that is formed at an angle to mate with or bridge the peak of the truss 20 and provides additional support to prevent front-to-back low impact collapse of the anchor portions 14 of the gussets 10.

When the roof anchor safety system 110 is no longer needed, the harnesses 52, tether lines 50, high reach accessories 40, D0rings 54 and the like, and support ferrule inserts 60, are removed from the anchor portions 14 and used again as needed. The anchor portions 14 are typically cut near the top of the truss 20 and then folded over the top of the truss 20. Alternatively, the anchor portions 14 may not need to be cut but rather just be bent over the truss and positioned below the roof. It is also contemplated that the anchor portions 14 may be covered and left in place, with or without a ferrule insert support 60 between the extensions 14.

In FIGS. 7-12, two additional embodiment of the peak gusset 210,310 are shown that are manufactured as one piece and then folded prior to attachment to form the truss 200, 300.

Figure 8:
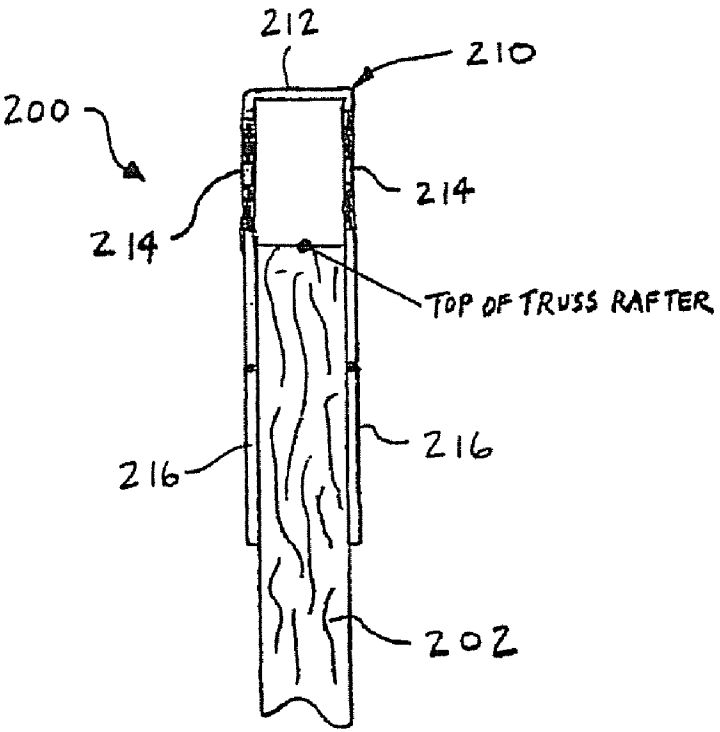
FIG. 8 is a side view of the double gusset of FIG. 7 shown attached to a truss rafter.
Figure 7:
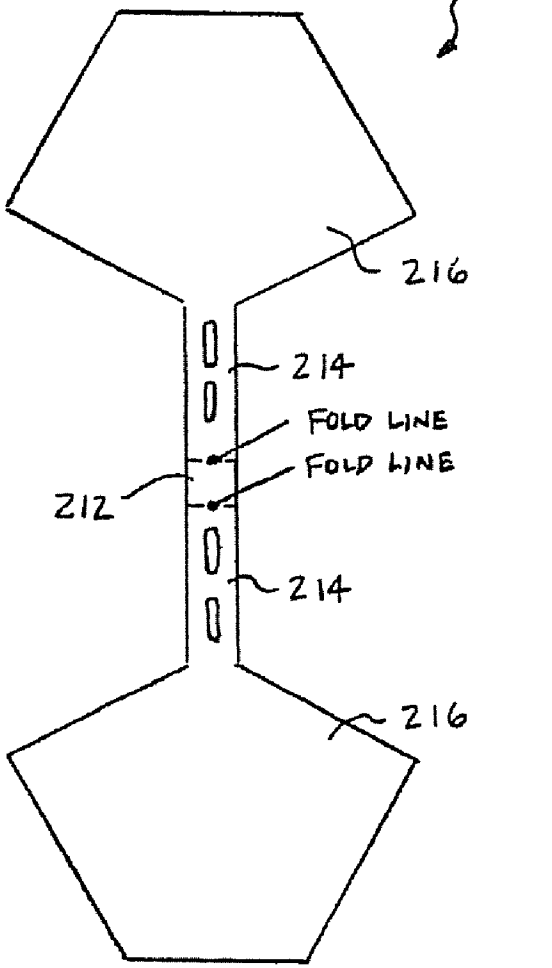
FIG. 7 is a front view of a second embodiment of the peak gusset of the present invention shown in a single piece configuration.
Figure 9:
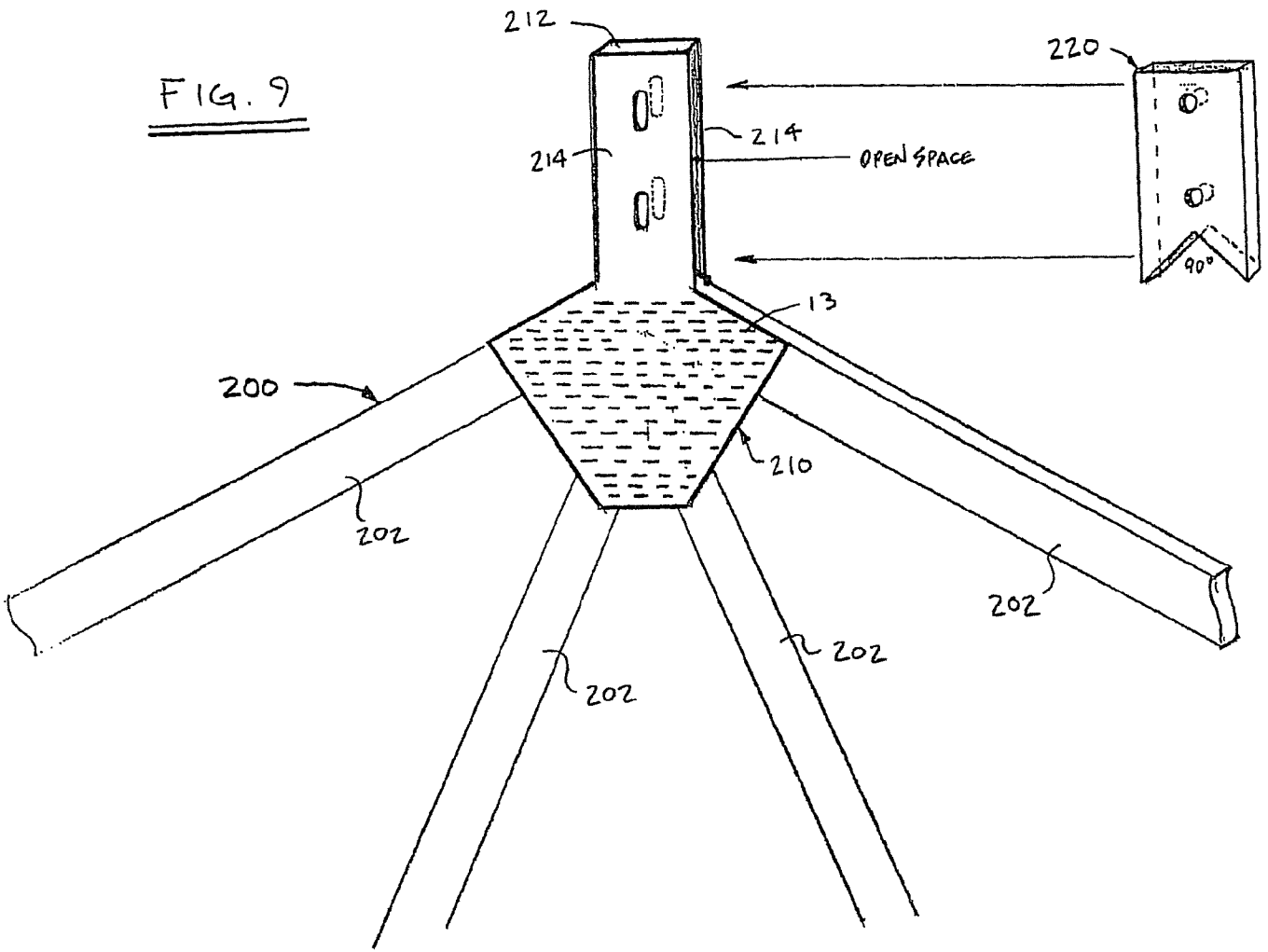
FIG. 9 is a partial perspective view of a truss formed with the double peak gusset of FIG. 7 and a support ferrule of FIG. 6 shown exploded therefrom.

Referring now to FIG. 7, a double peak gusset 210 is shown having a connection portion 212 between the anchor portions 214 of the double gusset 210. A plurality of teeth (not shown) extends perpendicularly from each plate portion 216. The double peak gusset 210 is folded on either end of connection portion 212 and attached to form a truss 200 by the plurality of teeth (not shown) engaging the truss members 202 as shown in FIG. 8. The attached peak gusset 210 is shown in a partial perspective view in FIG. 9. The peak gusset anchor portions 214 remain connected by connection portion 212, providing enhanced strength of the anchor portions 214. A support ferrule insert 220 is shown as insertable between the anchor portions 214 and underneath the connection portion 212.

Figure 11:
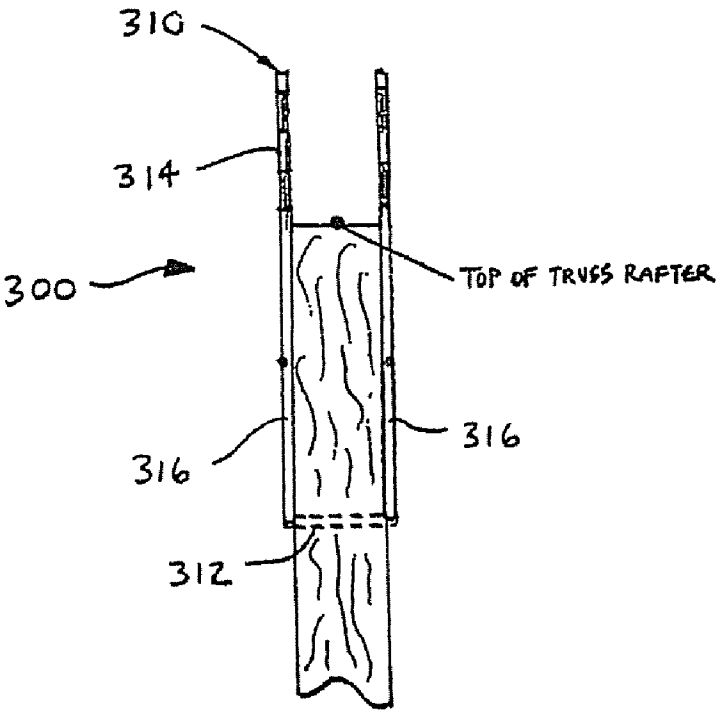
FIG. 11 is a side view of the double gusset of FIG. 10 shown attached to a truss rafter.
Figure 10:
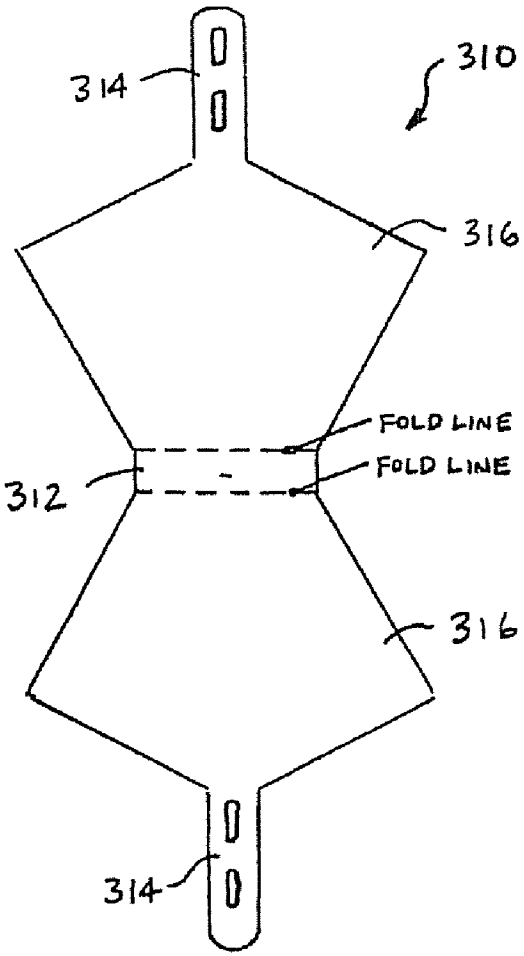
FIG. 10 is a front view of another embodiment of the peak gusset of the present invention shown in a single piece configuration.
Figure 12:
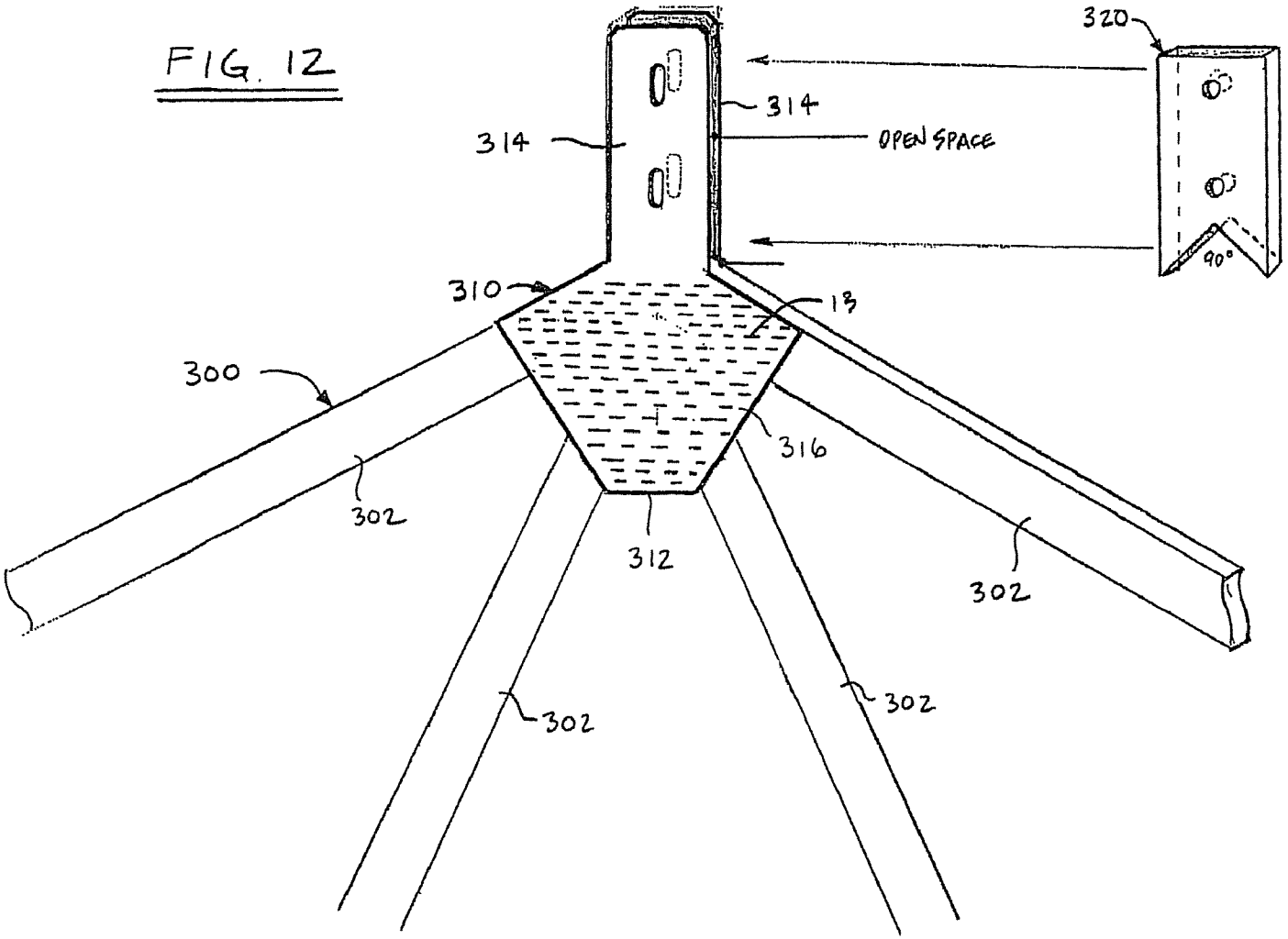
FIG. 12 is a partial perspective view of a truss formed with the double peak gusset of FIG. 10 and a support ferrule of FIG. 6 shown exploded therefrom.

Referring now to FIG. 10, another embodiment of a double peak gusset 310 is shown having a connection portion 312 between the plate portions 316 of the double gusset 310. A plurality of teeth (not shown) extend perpendicularly from each plate portion 316. The double peak gusset 310 is folded on either end of connection portion 312 and attached to form truss 300 by the plurality of teeth (not shown) engaging the truss members 302 as shown in FIGS. 11 and 12. The attached peak gusset 310 is shown in a partial perspective view in FIG. 12. The peak gusset plate portions 316 remain connected by connection portion 312. A support ferrule insert 320 is shown as insertable between the anchor portions 314 as shown in previous embodiments.

Figure 13:
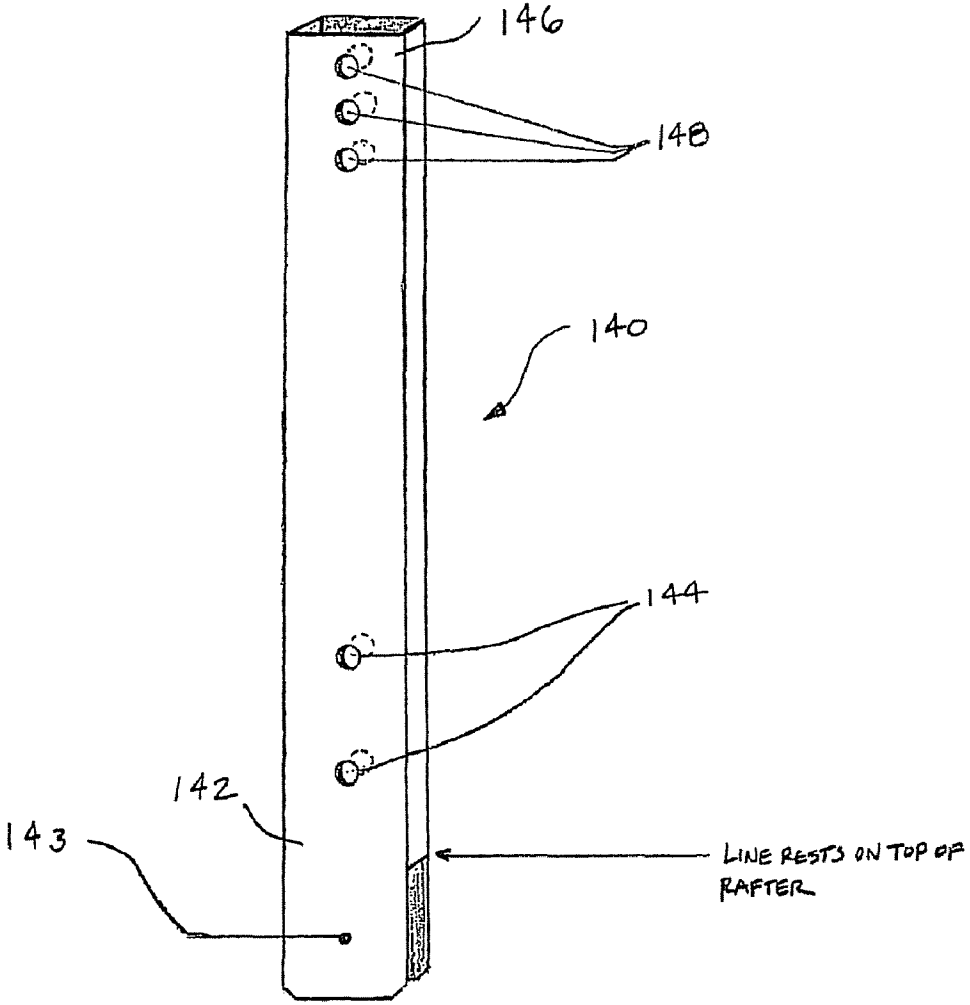
FIG. 13 is a perspective view of another embodiment of the high reach accessory of the roof anchor system of the present invention.
Figure 14:
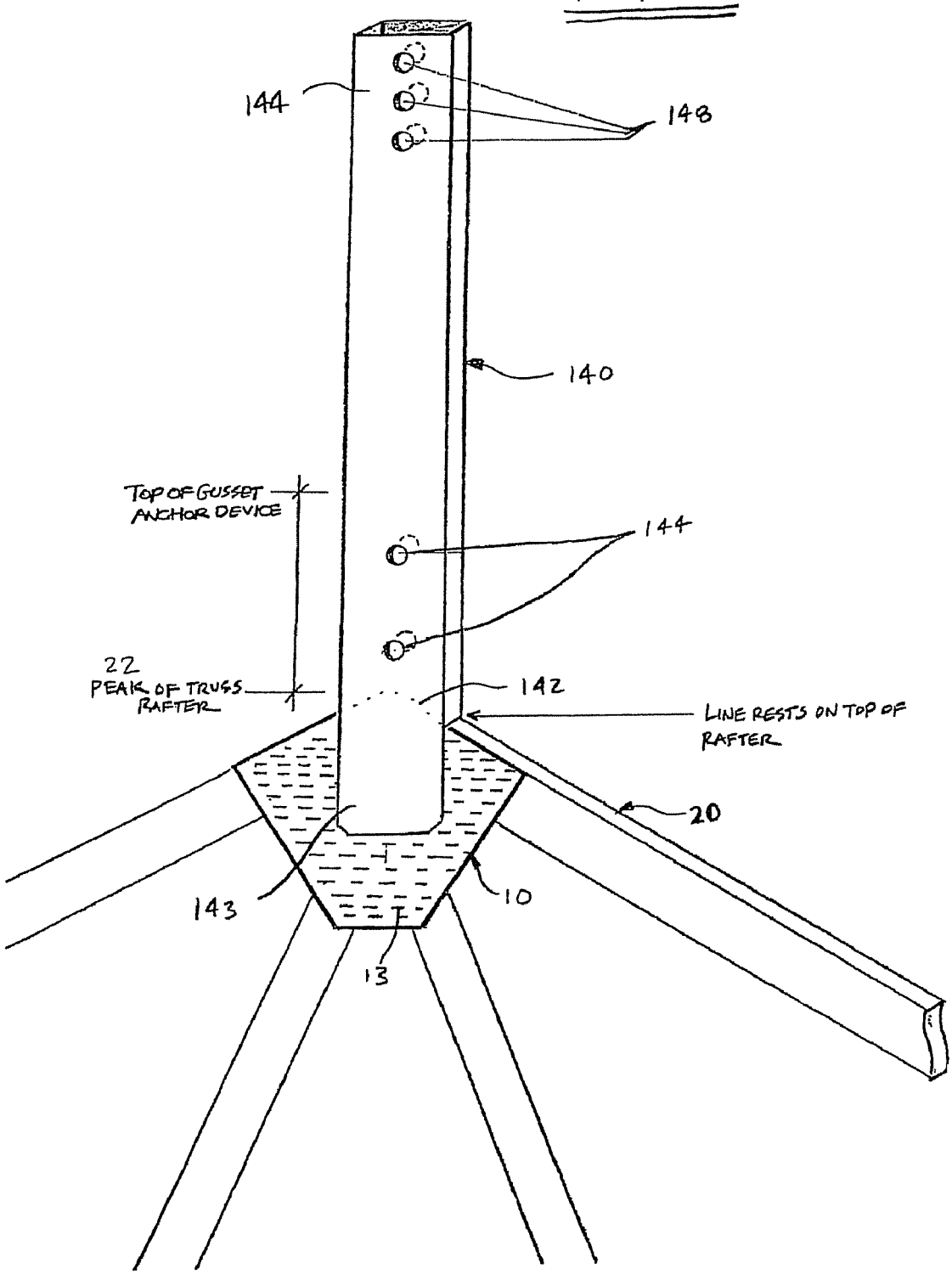
FIG. 14 is a perspective view of a high reach accessory of FIG. 13 shown attached over a portion of a truss using the peak gusset of the present invention.

A variation of the high reach accessory 140 is shown in FIG. 13. The high reach accessory 140 is similar to the previous embodiment of the high reach accessory 40 except that it has a rectangular tubular cross-section as opposed to a square cross-section, and apertures 144 and the first end 142 are circular as opposed to slots. The invention is not limited to a particular configuration of the high reach accessory 40, 140. As with the previous embodiment, the high reach accessory 140 also may include sidewall extensions 143 that extend over the sides of the truss peak 22 to provide additional stability and prevent low-impact side-to-side collapse of the anchor portions 14 of the gussets 10 as best shown in FIG. 14. The first end 142 fits over the anchor portions 14. As with the previous embodiment, the opposite end 1456 of the high reach accessory 140 includes attachment means 148 for attachment of other safety items, the attachment means 148 shown herein as a plurality of apertures 148.

Figure 15:
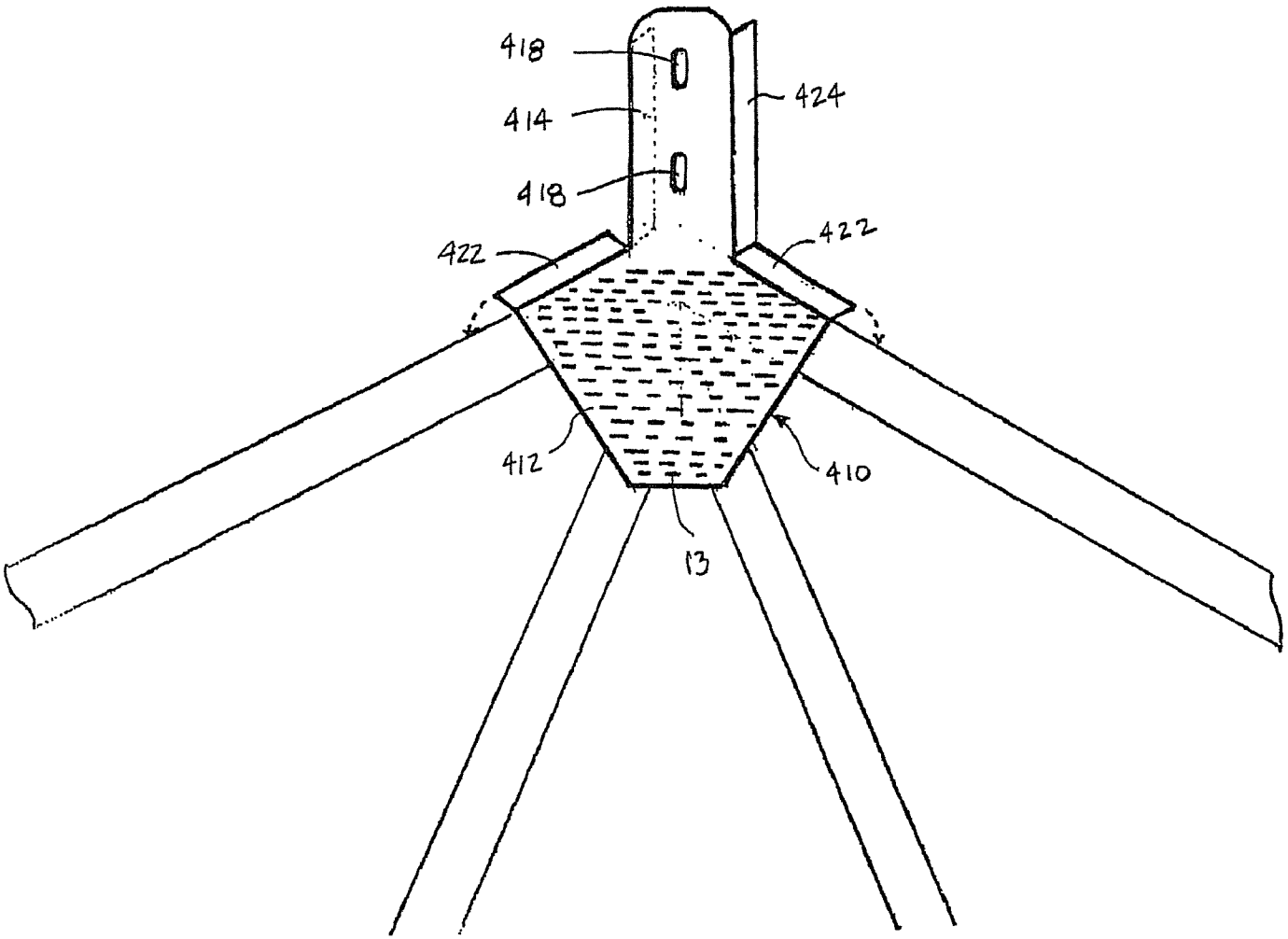
FIG. 15 is a partial perspective view of another embodiment of the peak gusset having fold over side reinforcements, shown attached to a plurality of truss rafters and truss webs.

Another embodiment of the peak gusset 410 is shown in FIG. 15. The peak gusset comprises a plate 412 of steel having a plurality of teeth (not shown) formed from the plate and extending perpendicularly from the plate 412. The peak gusset 410 further comprises an anchor portion 414 extending from the peak side of the gusset 410. The anchor portion 414 includes a means for attachment 418 of other safety items, the attachment means shown herein as a pair of apertures 418. Gusset 410 includes reinforcing flaps 428 extending from the anchor portion 414 and reinforcing flaps 422 extending from the plate 412. When a peak gusset 410 is attached to either side of a truss 400, the flaps 412, 422 of each gusset are folded perpendicular to their respective gussets 410 and provide additional support for the anchor portion 414. A support ferrule insert (not shown) may still be used. If needed, and is insertable through an opening at the top of the anchor portions 414 of the gussets 410.

Figure 16:
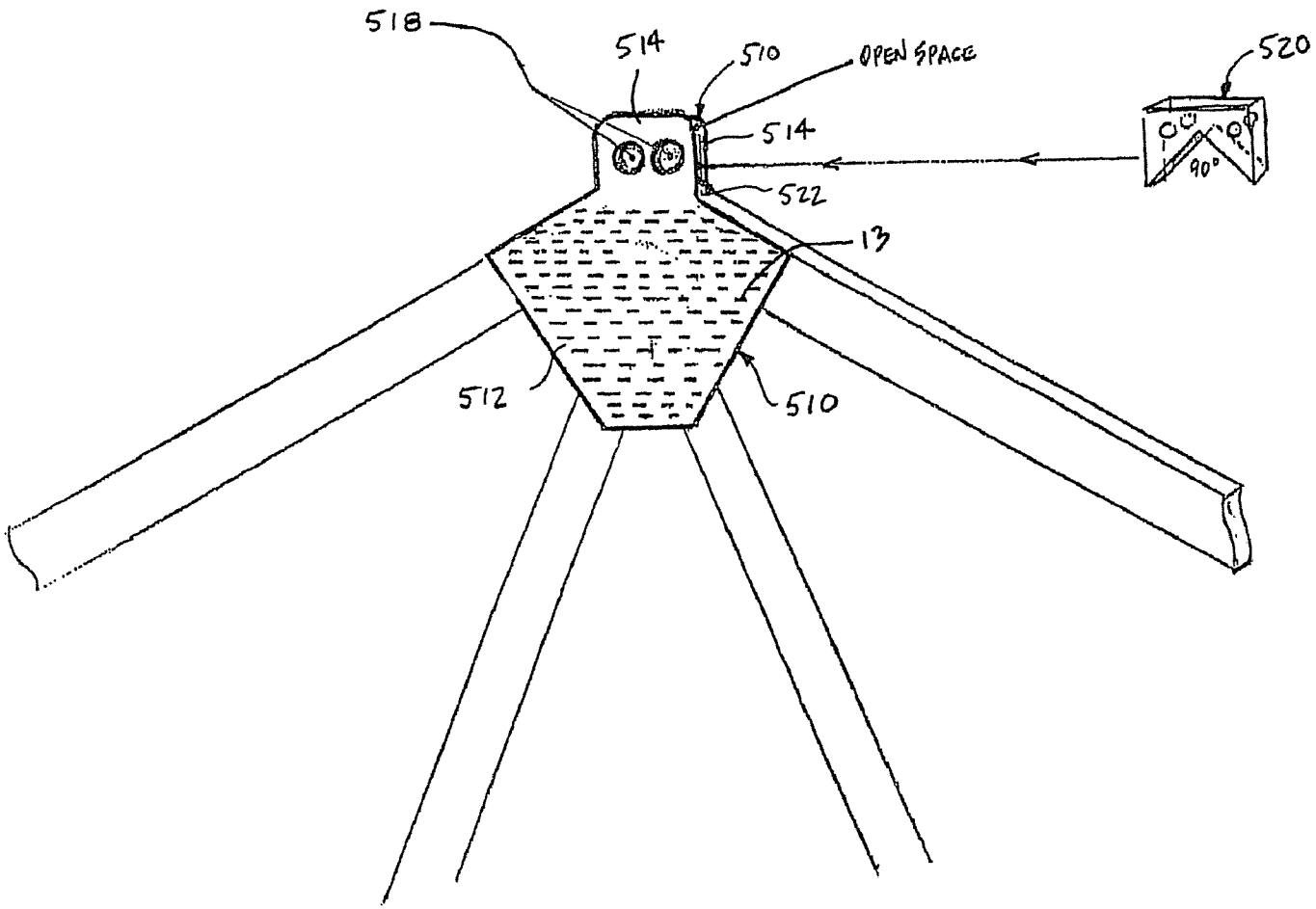
FIG. 16 is a partial perspective view of another embodiment of the peak gusset having a low profile attachment extension, shown attached to a plurality of truss rafters and truss webs.
Figure 17:
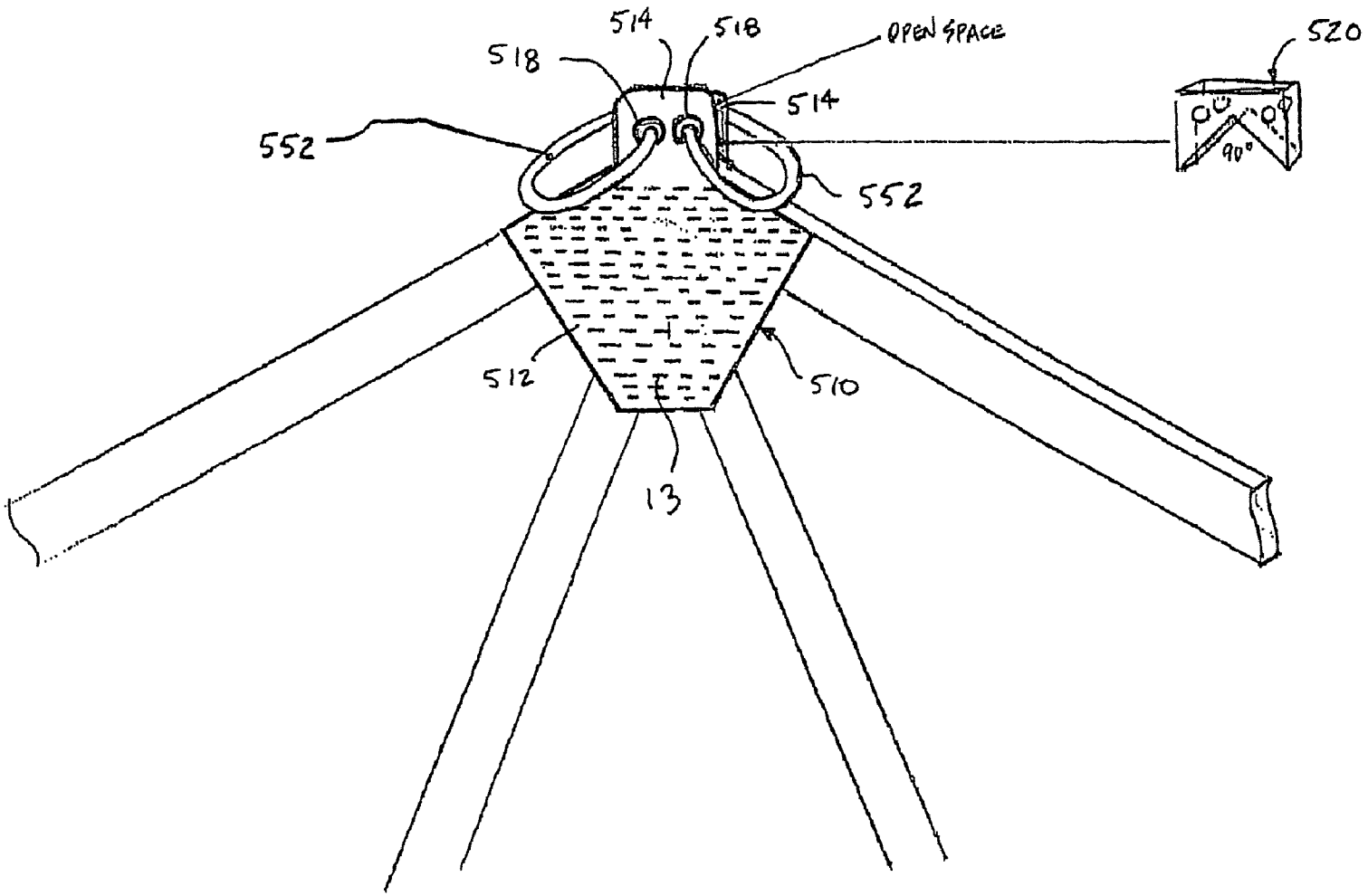
FIG. 17 is a partial perspective view of the peak gusset as shown in FIG. 16 having a plurality of D rings attached thereto as a cable harness hook up.

Another embodiment of the peak gusset 510 is shown in FIGS. 15 and 16. The peak gusset comprises a plate 512 of steel having a plurality of teeth (not shown) formed from this plate and extending perpendicularly from the plate 512. The peak gusset 510 further comprises an anchor portion 514 extending from the peak side of the gusset 510. The anchor portion 514 includes a means for attachment 518 of other safety items, the attachment means shown herein as a pair of apertures 518. A peak gusset 510 is attached to either side of a truss peak 522. A support ferrule 520 is shown as insertable between the anchor portions 514 as shown in previous embodiments. In FIG. 17, a pair of D-rings 552 is shown attached to the peak gussets 510.

Figure 19:
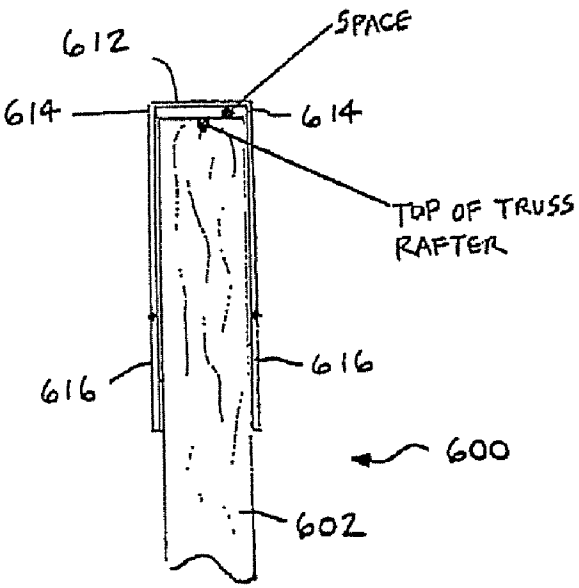
FIG. 19 is a side view of the peak gusset of FIG. 18, shown attached to a truss rafter.
Figure 18:
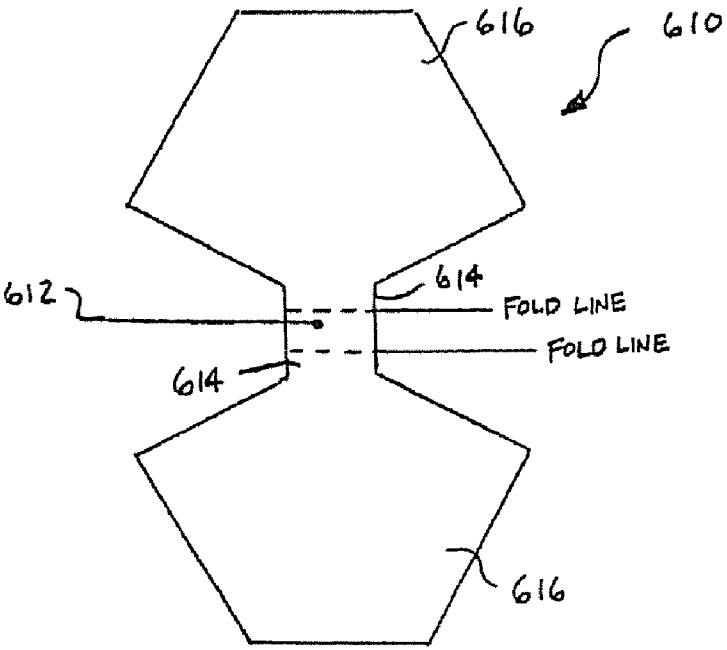
FIG. 18 is a front view of a low anchor profile embodiment of the peak gusset of the present invention shown in a single piece configuration.
Figure 20:
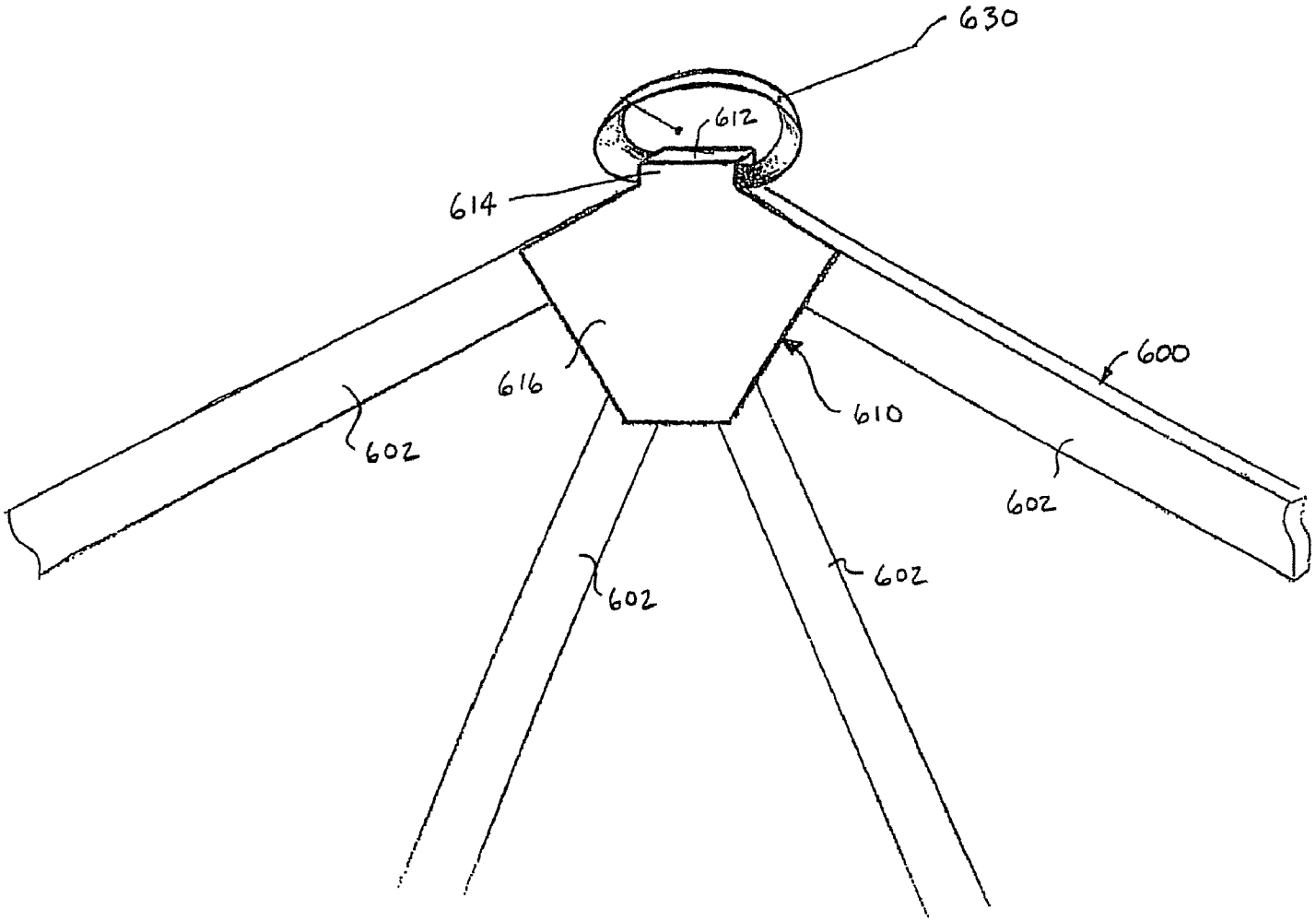
FIG. 20 is a partial perspective view of a truss formed with the peak gusset of FIG. 18 shown with a metal loop.
Figure 21:
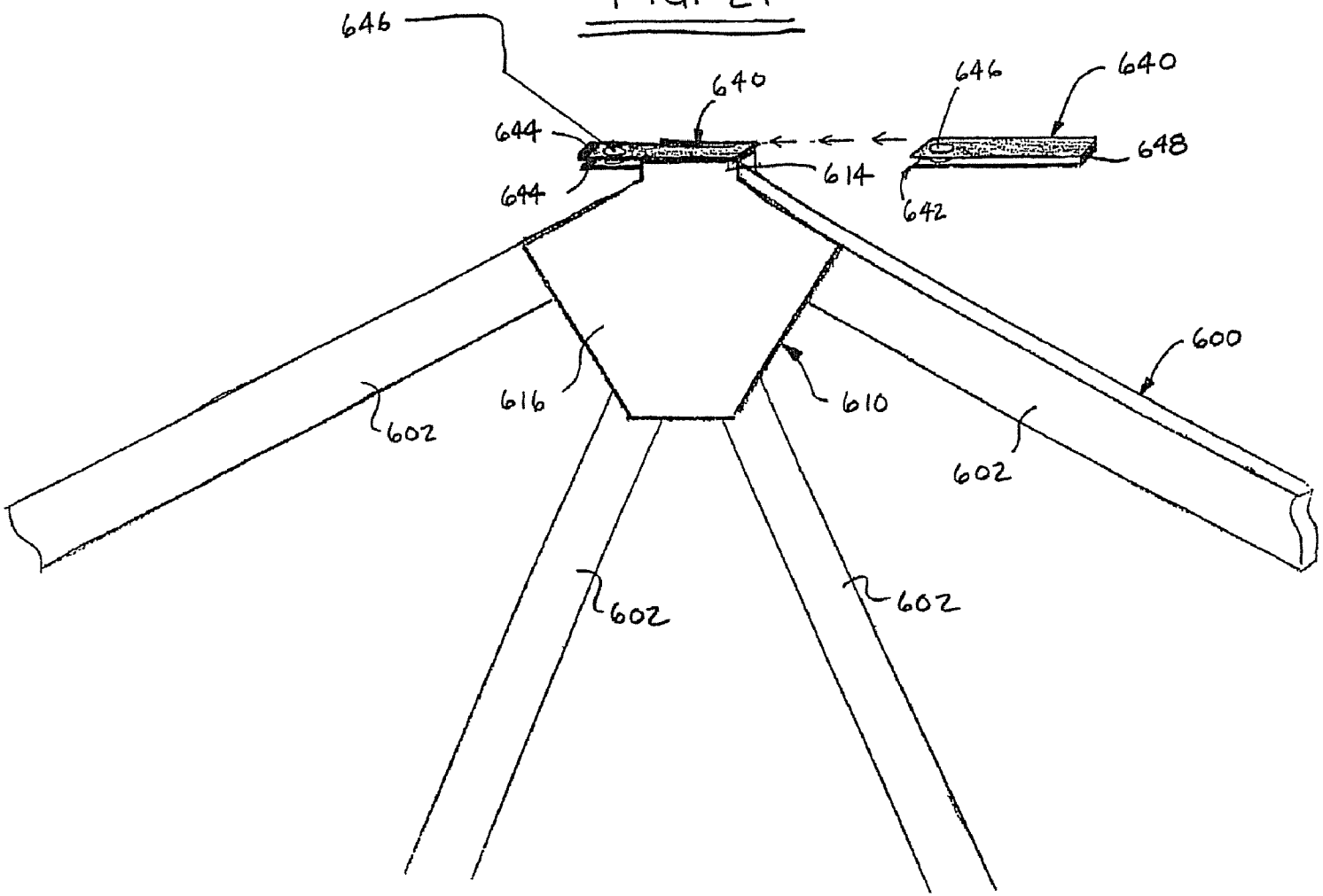
FIG. 21 is a partial perspective view of a truss formed with the peak gusset of FIG. 18 shown with a side clip.

The peak gussets 10, 210, 310, 410, and 510 all have a significant extension of the anchor above the truss. The peak gusset of the present invention may also be configured in a "low profile" configuration. Referring now to FIGS. 18 and 19, a double peak gusset 610 is shown that is manufactured as one piece and then folded prior to attachment to form the truss 600. Double peak gusset 610 comprises a connection portion 512 between the anchor portions 614 of the double gusset 610. A plurality of teeth (not shown) extends perpendicularly from each plate portion 616. The double peak gusset 510 is folded on either end of connection portion 512 and attached to form a truss 600 by the plurality of teeth (not shown) engaging the truss member 512 as shown in FIG. 19 such that the connection portion 612 forms a cap over the anchor portions 614. The peak gusset anchor portions 615 only extend a short distance above the peak of the truss 600 and remain connected by connection portion 612, providing enhanced strength. The attached peak gusset 610 is shown in a partial perspective view in FIG. 20 including a metal loop 630 which provides an attachment location for a harness cable hook up (not shown). Another variation is shown in FIG. 21 where a slide clip 640 is used to provide an attachment location for a harness cable hook up (not shown). Slide clip 640 is a U-shaped metal band. Connection portion 5612 of the peak gusset 510 is positioned between the legs 544 of the open end 642 of slide clip 640. Apertures 646 in the legs 644 of clip 540 provide an attachment location for a harness cable hook up. The harness cable hook up and the closed end 648 of the slide clip 640 act to secure the slide clip to the peak gusset 510. The low profile of the anchor portions 6145 and connection portion 612 make it so that they can remain in place and simply be covered by the roof peak (not shown) or by ridge shingles. Alternatively, the anchor portions 614 and connection portion 612 can be removed or bent out of the way as in previous embodiments.

Figure 23:
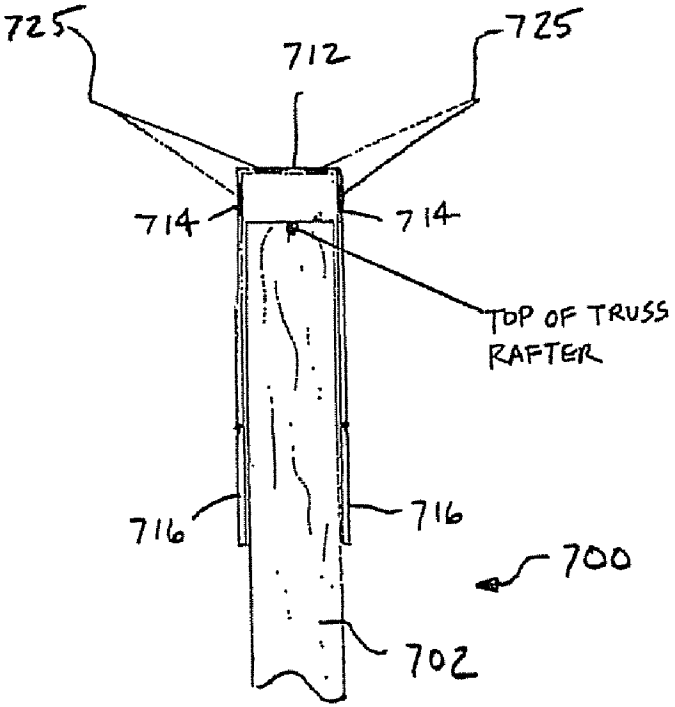
FIG. 23 is a side view of peak gusset of FIG. 22, shown attached to a truss rafter.
Figure 22:
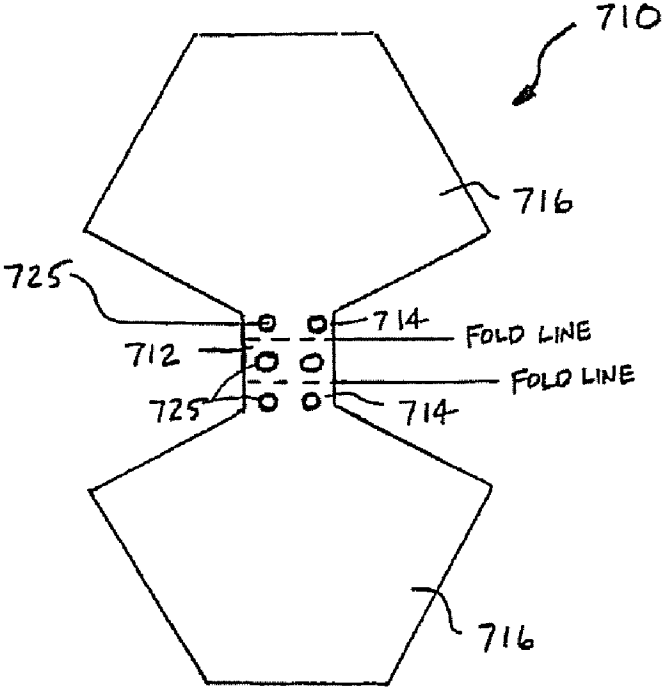
FIG. 22 is a front view of a second low anchor profile embodiment of the peak gusset of the present invention shown in a single piece configuration.
Figure 24:
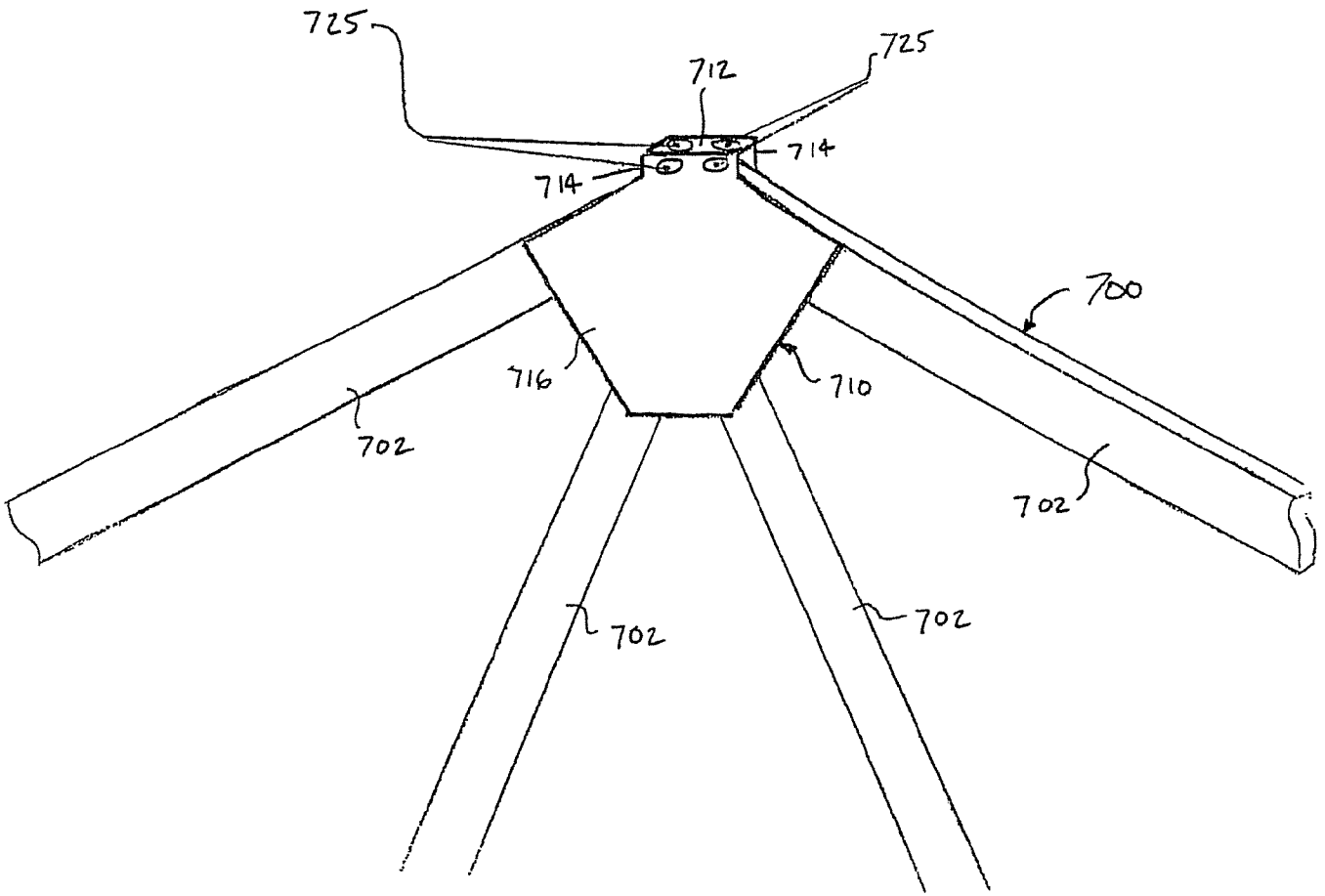
FIG. 24 is a partial perspective view of a truss formed with the peak gusset of FIG. 22.

Referring now to FIGS. 22 and 23, a second embodiment of a low profile double peak gusset 710 is shown. Peak gusset 710 is manufactured as one piece and then folded prior to attachment to form truss 700. Double peak gusset 710 comprises a connection portion 712 between the anchor portions 714 of the double gusset 710. A plurality of teeth (not shown) extends perpendicularly from each plate portion 716. A plurality of apertures 725 are formed in the anchor portions 714 and/or the connection portion 712. The double peak gusset 710 is folded on either end of connection portion 712 and attached to form a truss 700 by the plurality of teeth (not shown) engaging the truss member 712 as shown in FIG. 24. Apertures 725 provide an attachment location for a harness cable hook up. As with the previous embodiment, the low profile of the anchor portions 714 and connection portion 712 make it so they can remain in place and simply be covered by the roof peak vent (not shown) or ridge shingles. Alternatively, the anchor portions 714 and connection portion 712 can be removed or bent out of the way as in previous embodiments.

Figure 27:
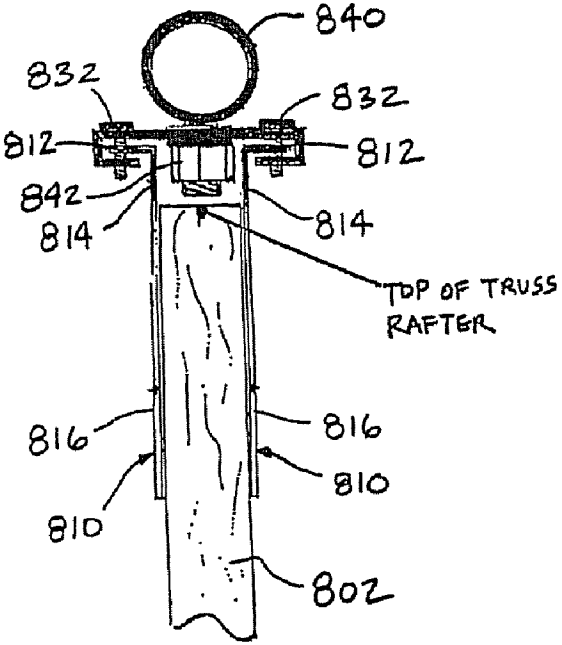
FIG. 27 is a side view of the peak gusset of FIG. 25, shown attached to a truss rafter with a slide-on eyebolt base and eyebolt attached to the peak gusset.
Figure 26:
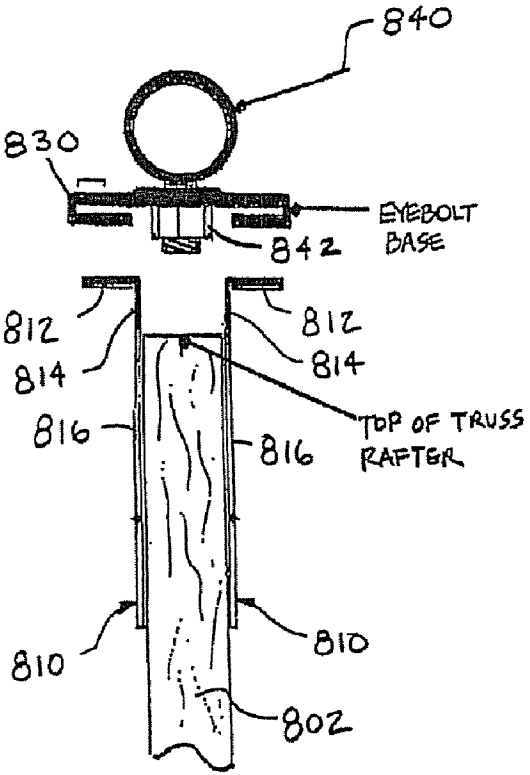
FIG. 26 is a side view of the peak gusset of FIG. 25, shown attached to a truss rafter with an unattached slide-on eyebolt base and eyebolt.
Figure 25:
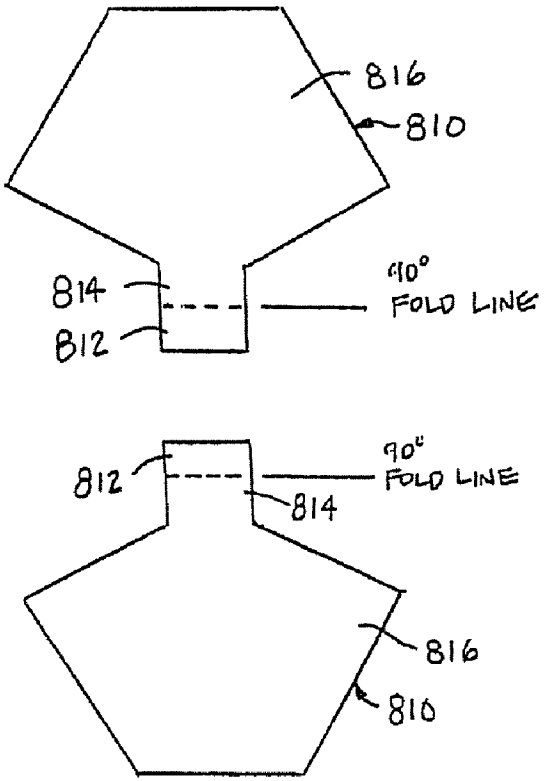
FIG. 25 is a front view of another embodiment of the peak gusset of the present invention.
Figure 28:
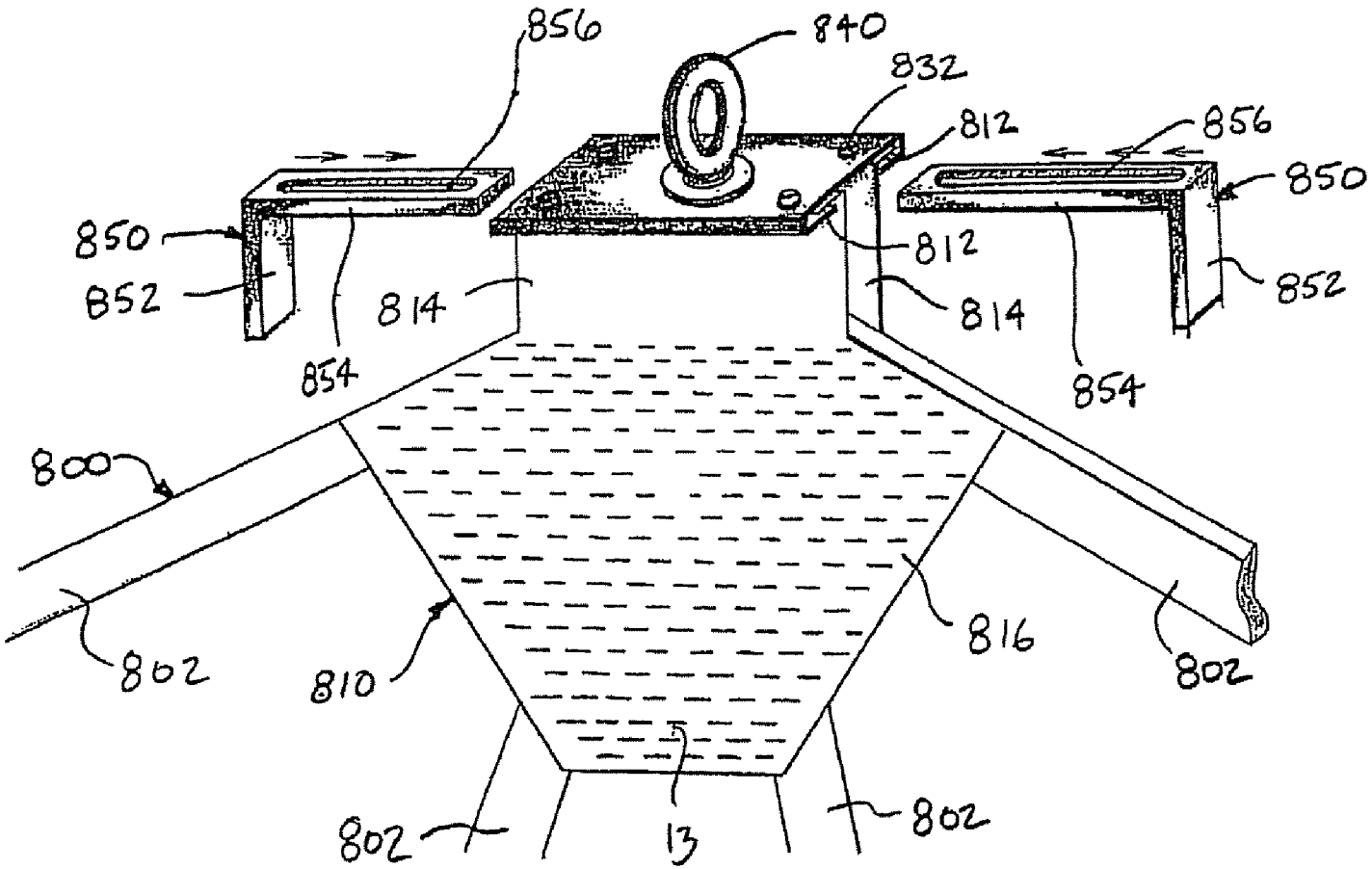
FIG. 28 is a partial perspective view of a truss formed with the peak gusset of FIG. 27 shown with a plurality of support members shown exploded therefrom.

Referring now to FIGS. 25-28, another embodiment of the peak gusset 810 is shown. Peak gusset 810 comprises a plate portion 816 and an anchor portion 814 extending therefrom and having a connection portion 812. A plurality of teeth (not shown) extends perpendicularly from each plate portion 816. The gusset plates 810 are attached to form a truss 800 by the plurality of teeth (not shown) engaging the truss members 802 as shown in FIG. 26. The connection portion 812 are folded outward from the anchor portion 814 of the gusset plates 810 to form a connection flange for a slide-on eyebolt base 830 having an eyebolt 840 attached thereto by a fastener 842. The eyebolt base 830 is slid over flanges 812 and secure thereto with a plurality of fasteners 832 as shown in FIG. 27. The attached peak gusset 810 is shown I a partial perspective view in FIG. 28 attached to truss 800. In order to provide additional strength for the eyebolt connection 840, a pair of support angles 850 is provided. The support angles 850 are designed such that the legs 854 next one under the other. A slot 856 is formed in the legs 854 to allow the shaft of the eyebolt 840 to pass through. The support angles 850 are fixed in position by eyebolt 840 and fastener 842.

Figure 30:
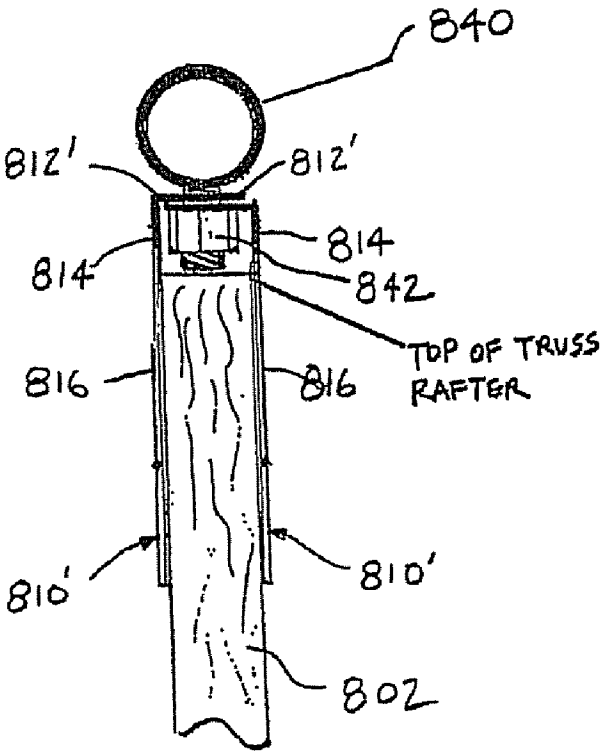
FIG. 30 is a side view of the peak gusset of FIG. 29, shown attached to a truss rafter with an eyebolt attached to the peak gusset.
Figure 29:
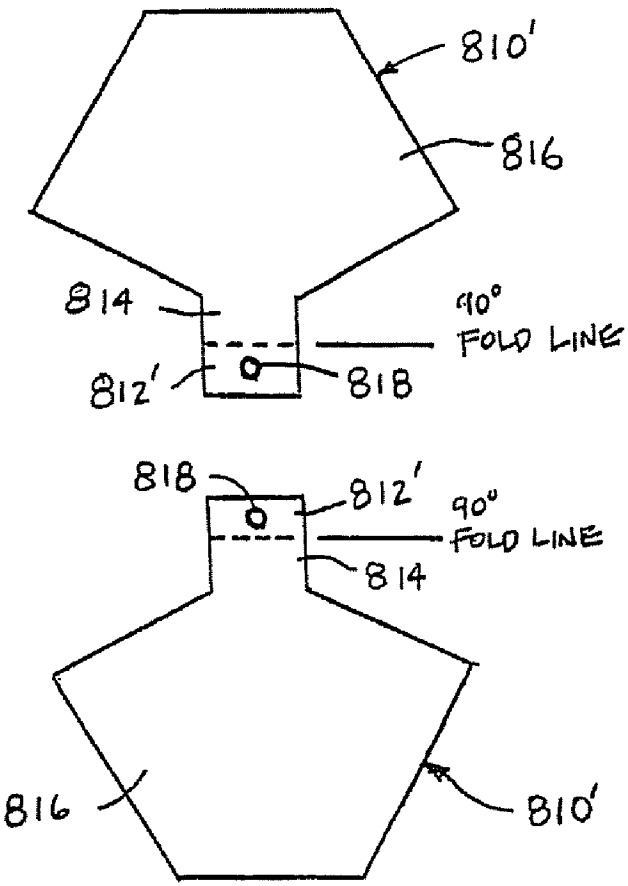
FIG. 29 is a front view of another embodiment of the peak gusset of the present invention similar to the embodiment of FIG. 25.
Figure 31:
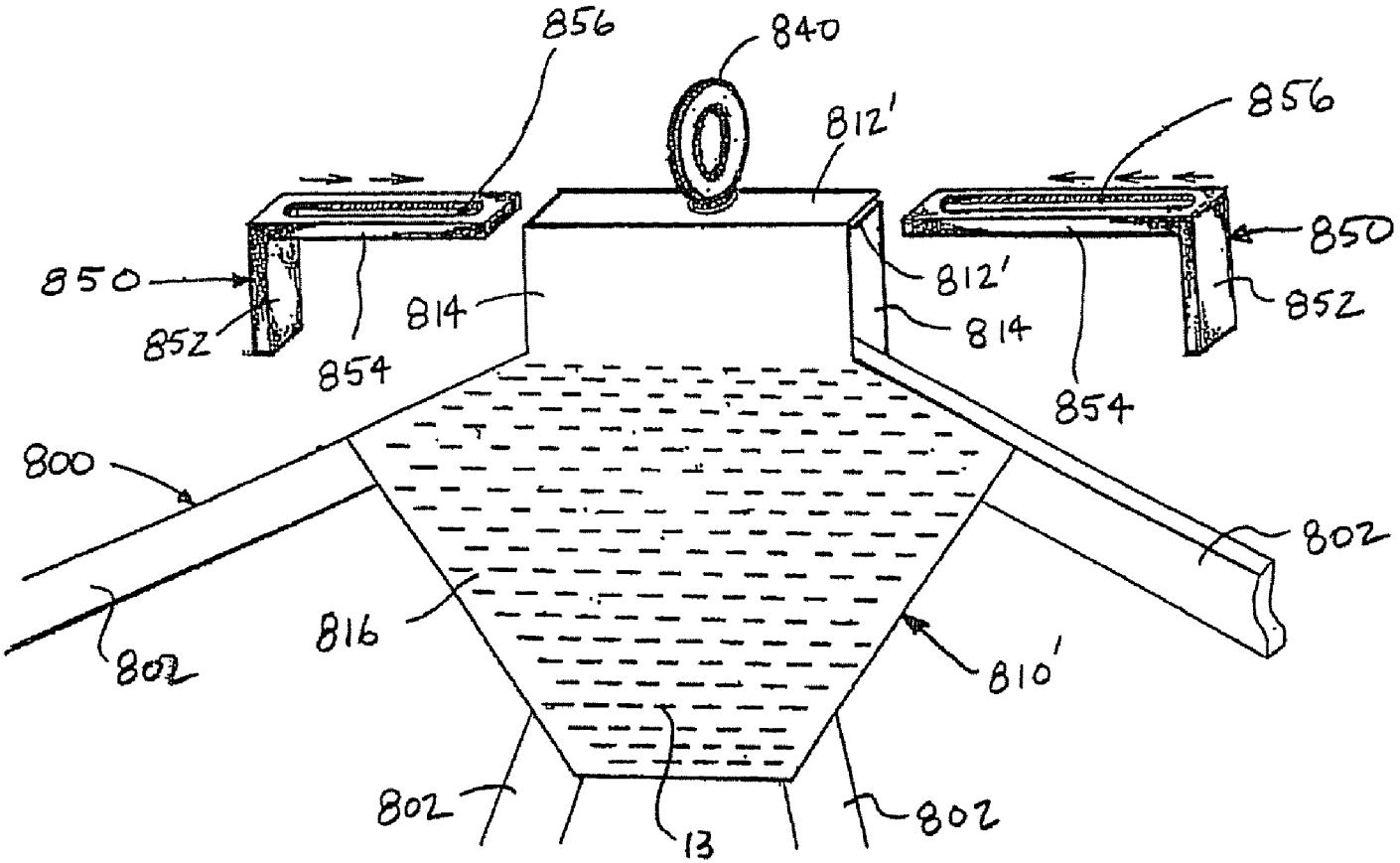
FIG. 31 is a partial perspective view of a truss formed with the peak gusset of FIG. 30 shown with a plurality of support members shown exploded therefrom.

Another variation of this embodiment is shown in FIGS. 29-31. In the embodiment shown in FIG. 29 the gusset plate 810' have an aperture 818 formed in connection portion 812'. As with the previous embodiment, the gusset plate 810' are attached to form a truss 800 by the plurality of teeth (not shown) engaging the truss member 802 as shown in FIG. 30. However, the connection portions 812' are folded inward from the anchor portions 814 of the gusset plate 810' such that the apertures 818 are aligned to allow the shaft of eyebolt 840 to pass and for the eyebolt 840 to be directly attached to the connection portion 812' by a fastener 842. The attached peak gusset 810' is shown in a partial perspective view in FIG. 31 attached to truss 800. In order to provide additional strength for the eyebolt connection 840, the pair of support angle 850 is provided as previously discussed and shown in FIG. 28.

Figure 33:
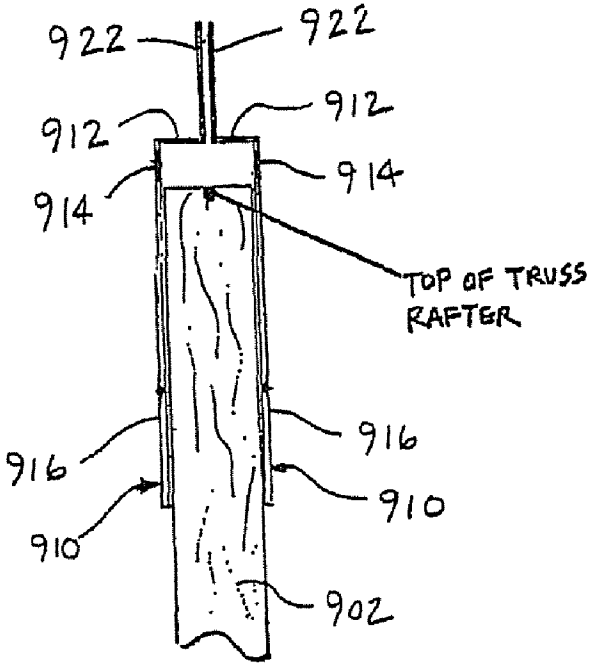
FIG. 33 is a side view of the peak gusset of FIG. 32, shown attached to a truss rafter.
Figure 32:
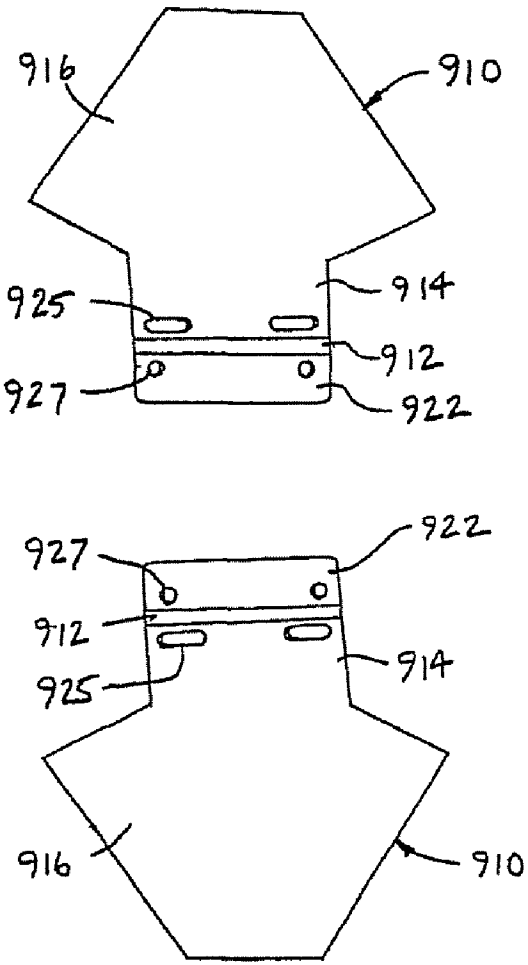
FIG. 32 is a front view of another embodiment of the peak gusset of the present invention utilizing gusset plates with a double fold.
Figure 34:
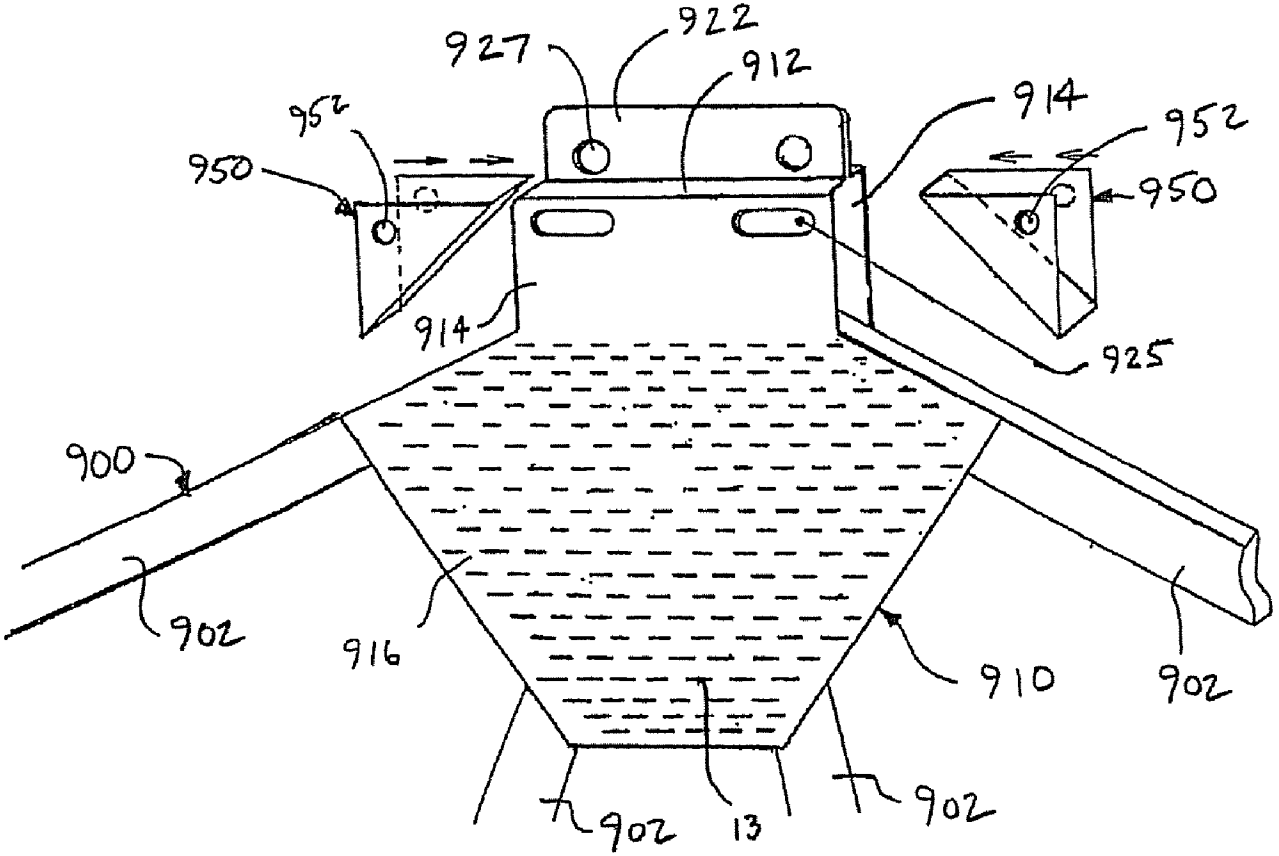
FIG. 34 is a partial perspective view of a truss formed with the peak gusset of FIG. 32 shown with a plurality of support members shown exploded therefrom.

Referring now to FIGS. 32-34, another embodiment of the peak gusset 910 is shown. As shown in FIG. 32, a pair of peak gussets 910 each comprises a plate portion 916 and an anchor portion 914 extending therefrom and having a connection portion 922 having at least one aperture 927 and a shoulder portion 912 having at least one aperture 925. A plurality of teeth (not shown) extends perpendicularly from each plate portion 915. The gusset plates 910 are attached to form a truss 900 by the plurality of teeth (not shown) engaging the truss member 902 as shown in FIG. 33. The shoulder portions 912 are folded inward from the anchor portion 914 of the gusset plates 910 and connection portion 922 are folded away from anchor portion 914 such that connection portion 922 and anchor portion 914 are generally parallel to each other. The attached peak gussets 910 are shown in a partial perspective view in FIG. 34 attach to truss 900. In order to provide additional strength for the anchor portion 912, a pair of support block wedges 950 is provided. The support blocks 950 each are configured to engage the top of the rafter 902 and the interior of shoulder portion 912. The support blocks 950 include an aperture 952 that is aligned with aperture 925 of the anchor portion to allow the support block 950 to be fastened to the gusset plates 910 by a fastener (not shown). The apertures 927 in the connection portion 922 provide anchor connection locations for users. It is noted that the support block edge 950 is shown with open sides and a closed bottom. This allows access such that the hard shaft of the support block fastener can be used as an alternative hook location for the safety line carabiner.

Figure 36:
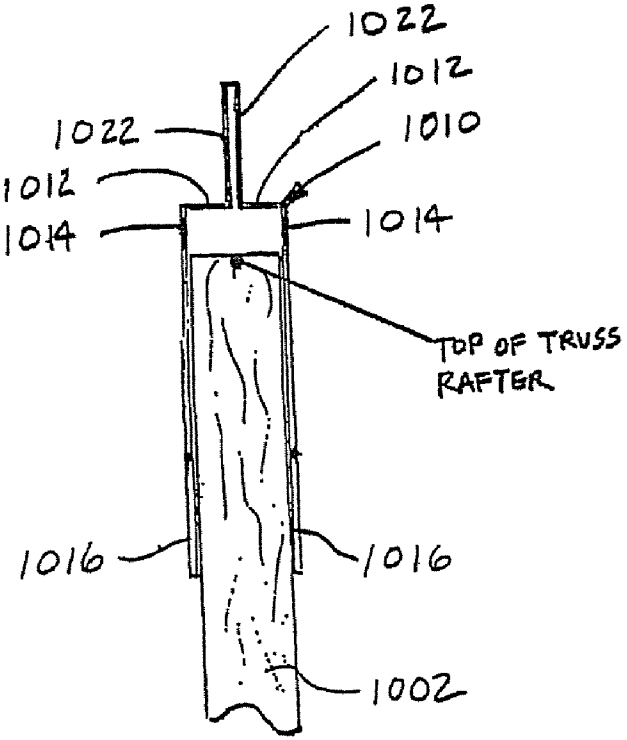
FIG. 36 is a side view of the peak gusset of FIG. 35, shown attached to a truss rafter.
Figure 35:
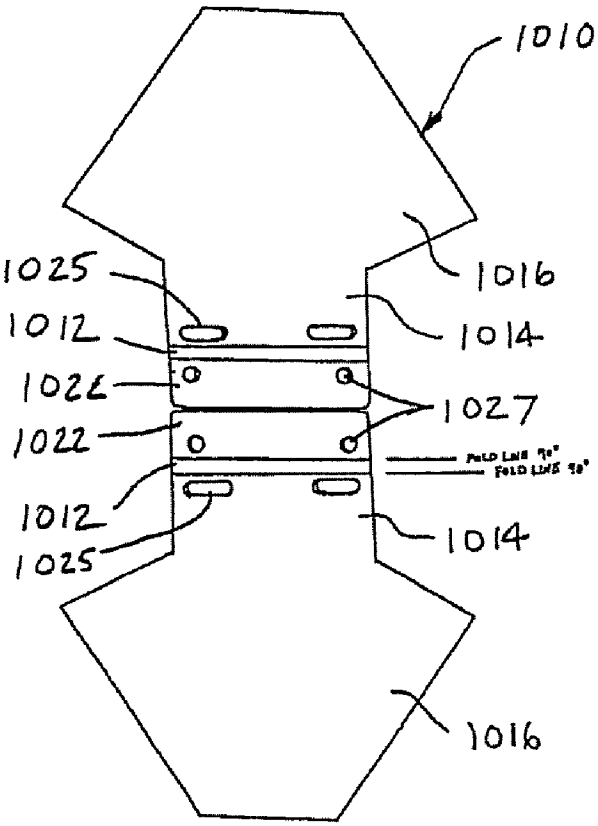
FIG. 35 is a front view of another embodiment of the peak gusset of the present invention, which is a one-piece version of the gusset plate of FIG. 32.

Another embodiment of the invention is shown in FIGS. 35 and 36 and is a double gusset version of the embodiment shown in FIGS. 32-34. A double peak gusset 1010 is shown that is manufactured as one piece and then folded prior to attachment to form the truss. Double peak gusset 1010 comprises a pair of shoulder portions 1012 and a pair of connection portions 1022 each having at least one aperture 1027, between the anchor portions 1014 of the double gusset 1010.

The shoulder portions 1012 are folded inward from the anchor portions 1014 of the double gusset plate 1010 and connection portions 1022 are folded away from anchor portions 1014 such that connection portions 1022 and anchor portion 1014 are generally parallel to each other. A plurality of teeth (not shown) extends perpendicularly from each plate portion 1016. The double peak gusset 1010 is folded and attached to form a truss by the plurality of teeth (not shown) engaging the truss members 1002 as shown in FIG. 36. As with the previous embodiment, it is contemplated that support blocks 950 could be used to strengthen the anchor portion 1014.

Figure 37:
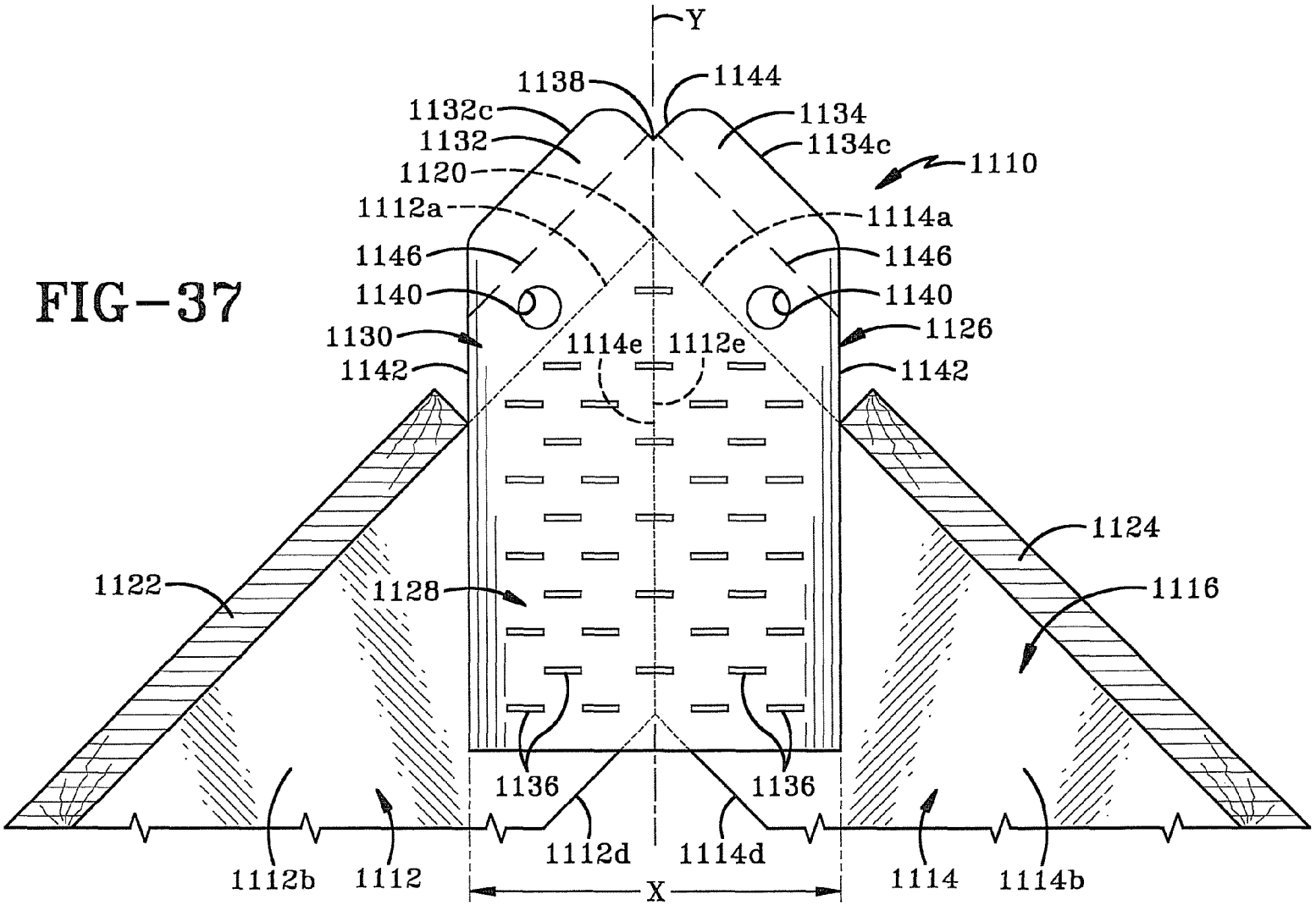
FIG. 37 is a front view of another embodiment of the peak gusset of the roof anchor system of the present invention shown attached to a truss with the peak of the truss shown in phantom and sheet material secured to the truss.

Referring to FIGS. 37-41, there is shown yet another embodiment of a peak gusset plate in accordance with the present invention and generally indicated at 1110. Peak gusset 1110 is designed to be permanently and non-removably secured to a roof truss at a manufacturing facility. The roof truss so formed includes a permanently available anchoring member for a security line for a roofer. FIG. 37 shows the uppermost region of a first roof truss 1116 that includes a first truss member 1112 and a second truss member 1114. First truss member 1112 has an upper surface 1112*a*, a side surface 1112*b*, an opposed second side surface 1112*c*, a bottom surface 1112*d*, and an angled end 1112*e*. Second truss member 1114 has an upper surface 1114*a*, a side surface 1114*b*, a second side surface 1114*c*, a bottom surface 1114*d*, and an angled end 1114*e*. Angled ends 1112*e*, 1114*e* are placed in abutting contact with each other so that first and second truss members 1112, 1114 form an apex or peak 1120. The peak gusset 1110 in accordance with the present invention is secured to a portion of side surface 1112*b* of first truss member 1112 and to a portion of side surface 1114*b* of second truss member 1114 adjacent the peak 1120 as will be hereinafter described. It will be understood, however, that truss 1116 may be constructed differently, such as having a molded top portion, which includes the peak 1120, and a plurality of truss members extending from this molded top portion.

In accordance with the present invention, peak gusset 1110 comprises a substantially planar steel plate 1126 that includes an attachment region 1128 and an anchor portion 1130. Peak gusset 1110 may also include a pair of flaps 1132, 1134 which may be provided to increase the strength of peak gusset 1110 and aid in preventing injury to persons working on the roof. Flaps 1132, 1134 may be omitted if the steel plate 1126 is of sufficient strength to support a security line. Attachment region 1128, anchor portion 1130 and flaps 1132, 1134 are integrally formed and coplanar with each other. Attachment region 1128 includes a plurality of gripping teeth that extend outwardly from a rear surface thereof and are disposed substantially at right angles thereto. The number 1136 in the attached figures indicates the region of teeth 1136 as seen from the front of peak gusset 1110 when attached to first roof truss 1116. Teeth 1136 are substantially identical to teeth 13 and are pressed into portions of side surfaces 1112*b*, 1114*b* during construction of truss 1116.

Anchor portion 1130 of peak gusset 1110 is integral with and extends outwardly away from attachment region 1128 and preferably is coplanar with attachment region 1128. Anchor portion 1130 preferably is generally triangular in shape, terminating in an apex 1138 that is aligned with peak 1120 of first truss 1116. Peak gusset 1110 has a longitudinal axis "Y" that extends through apex 1138 and is designed to be aligned with the abutting angled ends 1112*e*, 1114*e* of first and second truss members 1112, 1114. Anchor portion 1130 extends laterally outwardly away from peak 1120 as shown in FIG. 37 and may also extend vertically beyond peak 1120. Anchor portion 1130 preferably has an upper section that is substantially free of teeth or has minimal numbers of teeth. This upper section is designed to be disposed laterally above upper surfaces 1112*a*, 1114*a*. Anchor portion 1130 may extend vertically above and laterally outwardly beyond peak 1120 and therefore is not and does not need to be directly secured to first roof truss 1116 other than by way of attachment region 1128.

In accordance with a specific feature of the present invention, a pair of holes 1140 is defined in the upper section of anchor portion 1130. Holes 1140 are spaced a distance horizontally apart from each other and a short distance inwardly of side edges 1142 of anchor portion 1130. Holes 1140 are also spaced a distance inwardly from flaps 1132, 1134. Holes 1140 are aligned with each other and are disposed along a horizontal axis that is at right angles to the longitudinal axis "Y" of peak gusset 1110. Holes 1140 are positioned so that when attachment region 1128 is secured to truss 1116, holes 1140 will be positioned vertically above upper surfaces 1112*a*, 1114*a* of the first and second truss members 1112, 1114 and vertically beneath the apex 1120 of first truss 1116.

Figure 38A:
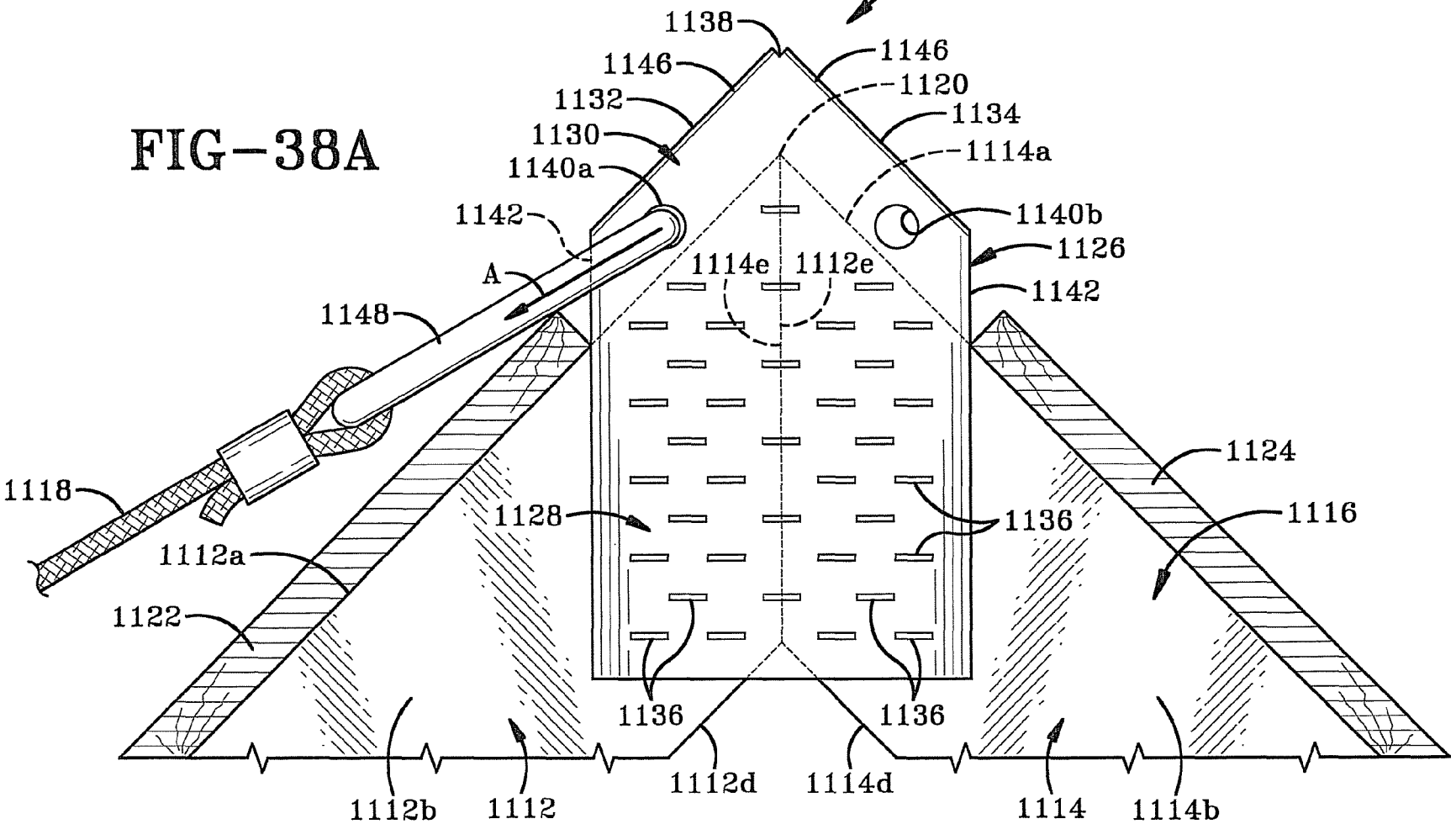
FIG. 38*a* is a front view of the peak gusset of FIG. 37 with a carabiner and rope secured through a first one of the holes in the gusset.
Figure 38B:
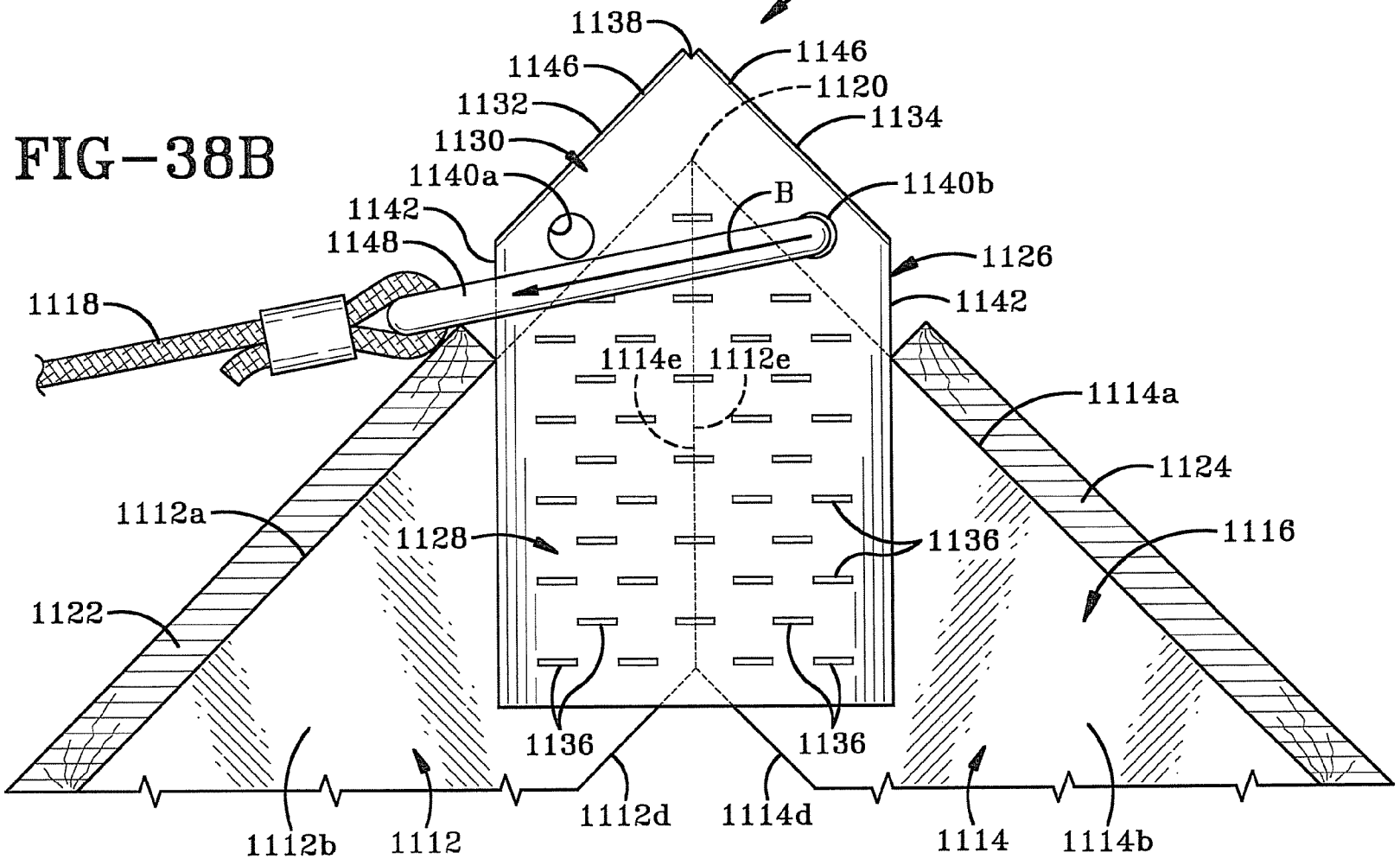
FIG. 38*b* is a front view of the peak gusset of FIG. 37 with the carabiner and rope secured through the second one of the holes in the gusset.
Figure 39:
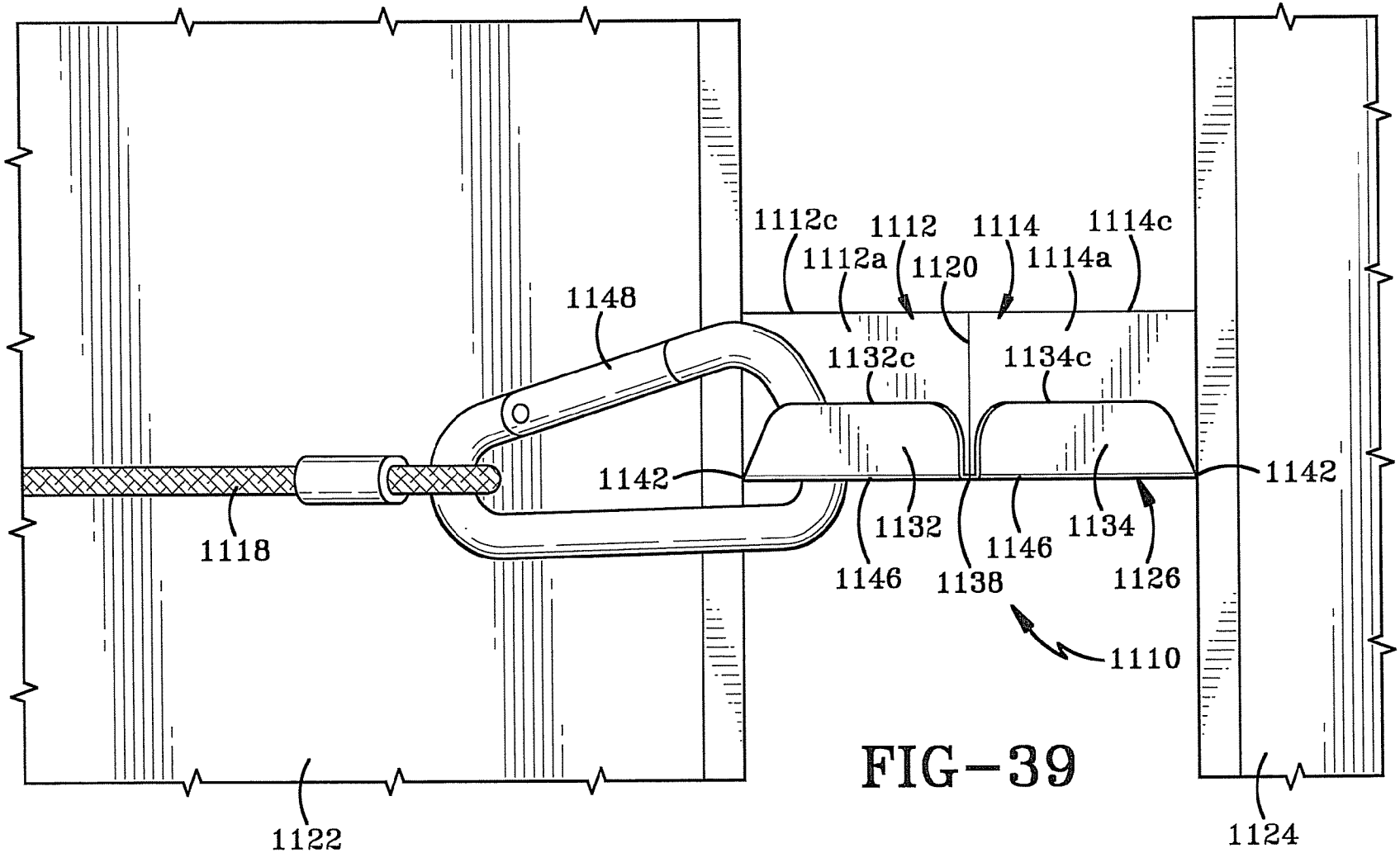
FIG. 39 is a top view of the peak gusset of FIG. 38 with the carabiner resting on the uppermost edge of the sheet material.
Figure 43:
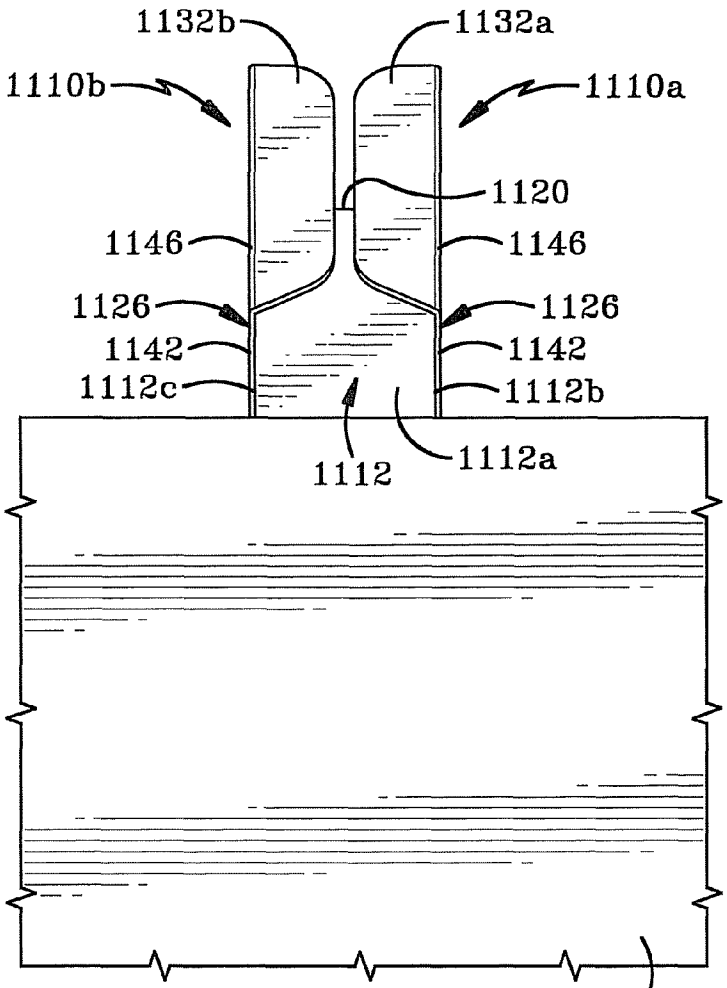
FIG. 43 is a side view of the pair of peak gussets of FIG. 42.
Figure 40:
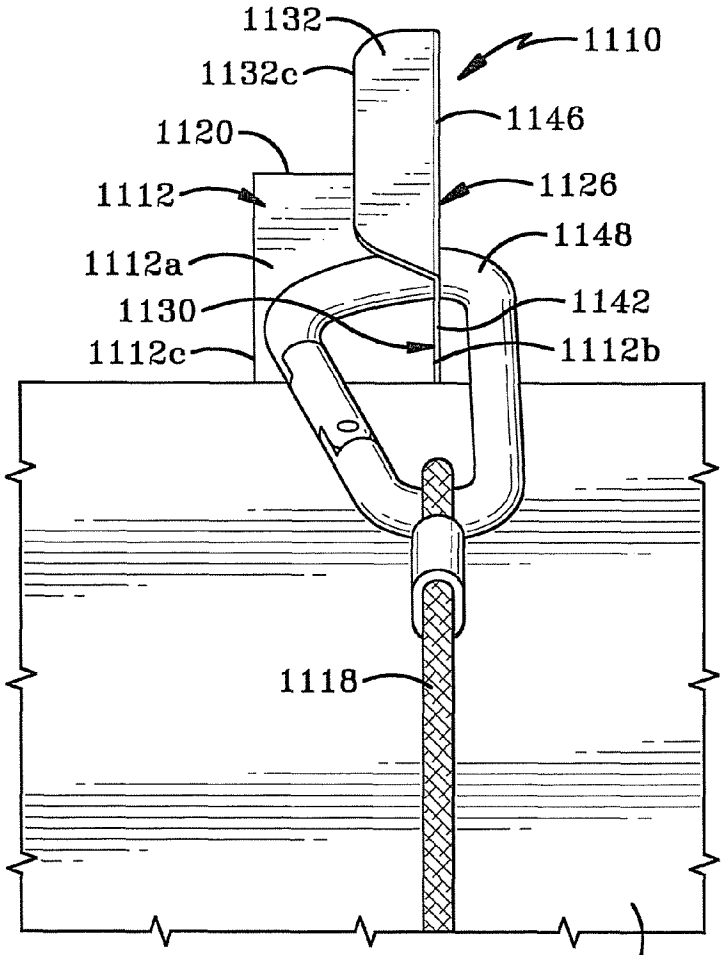
FIG. 40 is a side view of the peak gusset of FIG. 38 showing the top flap folded over.

Flaps 1132, 1134 are integral with anchor portion 1130 and extend outwardly away therefrom. These flaps add metal strength and resistance to peak gusset 1110. Flaps 1132, 1134 may be left coplanar with and extended outwardly away from anchor portion 1130 as shown in FIG. 37. Each flap 1132, 1134 is provided with an arcuate or rounded outermost edge 1132*c*, 1134*c* so as not to present any sharp edges or corners on which a roofer may injure himself when the flaps are in this coplanar position. Flaps 1132, 1134 may be separated from each other by a small space 1144 proximate apex 1138 of anchor portion 1130. Space 1144 permits each flap 1132, 1134 to be individually bent about a fold line 1146 and out of alignment with anchor portion 1130. Alternatively, instead of providing a space 1144 between flaps 1132, 1134, they may be overlapped (not shown) to offer more metal strength to peak gusset 1110. Flaps 1132, 1134 may be bent through ninety degrees and into a first position where they extend outwardly at right angles to anchor portion 1130. It will be understood that flaps may be bent through ninety degrees and in a direction where they extend over the wood truss members 1112, 1114 as shown in FIGS. 38 and 39, or they may be bent through ninety degrees in the opposite direction and therefore away from truss members 1112, 1114 (not shown). When flaps 1132, 1134 are bent into the first position, the rounded upper edge formed along the fold line 1146 presents a smooth surface that ensures a roofer is less likely to injure himself on peak gusset 1110. The steel selected for peak gusset 1110 is, of course, of a sufficient strength to enable just a single peak gusset to be utilized as a securing anchor. The steel might therefore require tempering or might need to be of increased thickness, at least in the region of anchor portion 1130. Although not illustrated in the attached drawings, one method of achieving an increase in the steel thickness in the anchor portion region would be to bend flaps 1132, 1134 through 180 degrees so that they are in a second position. It will be understood that this bending can be accomplished in a first direction where flaps 1132, 1134 are bent so that they abut the rear surface of peak gusset 1110 or in a second direction where they abut the front surface of peak gusset. Apertures will then have to be punched through both flaps 1132, 1134 so as to align with holes 1140 in anchor portion 1130. This will double the strength of the material around holes 1140 and reduce the possibility of failure of peak gusset 1110. In this second position, fold line 1146 in gusset 1110 would again be smooth and rounded to aid in preventing possible accidents. It will be understood that flaps 1132, 1134 may be put into either of the first and second positions at the manufacturing facility or at the building site.

The peak gusset 1110 of the present invention is used as part of an anchoring system that includes gusset 1110, and a security line 1118. The roof being constructed requires the use of a plurality of roof trusses that are substantially identical to first roof truss 1116, each truss having a peak gusset 1110 secured thereto. The plurality of roof trusses can be considered to have a longitudinal axis that extends horizontally through the aligned peaks of the trusses. Each peak gusset 1110 is secured to one of the plurality of roof trusses substantially at right angles to this longitudinal axis. Once all of the roof trusses 1116 are mounted to the wall framing, planar sheets of material, such as plywood sheets, are secured thereto and shingles are applied thereon. FIG. 37 shows a first sheet member 1122 secured to upper surface 1112*a* of first truss member 1112 and a second sheet member 1124 secured to upper surface 1114*a* of second truss member 1114. Sheet members 1122, 1124 do not extend all of the way to peak 1120 but, instead, have an edge that terminates a short distance away therefrom. Consequently, a gap is formed between the edges of sheet members 1122, 1124 and this gap is of a width "X". The gap allows hot air trapped in the roof to escape from beneath sheet members 1122, 1124. The gap, which runs substantially the entire length of the roof, is ultimately covered by a ventilation cap 1150 (FIG. 41) as will be hereinafter described. Peak gusset 1110 is of a width suitable to be received in the gap between the ends of sheet members 1122, 1124. Peak gusset 1110 may be sized to be complementary to the gap and therefore have a width substantially equal to "X". Alternatively, gusset 1110 may be of a slightly smaller width than "X". It will be understood the sheet members 1122, 1124 are secured to truss 1116 and to a second truss (not shown) that is spaced a distance horizontally apart from truss 1116. First sheet member 1122 extends between coplanar first upper walls of the first and second trusses; and second sheet member 1124 extends between coplanar second upper walls of the first and second trusses. The gap runs between the edges of these first and second sheets from the first truss to the second truss. A second, substantially identical gusset plate may be installed in a substantially identical manner to the manner described with reference to gusset plate 1110.

When a roofer is ready to roof the building, he attaches a first connector (not shown) at a first end of security line 1118 to a harness that he is wearing. He also attaches a carabiner 1148 that is at a second end of security line 1118 to one of the holes 1140 of peak gusset 1110. As shown in FIG. 38*a*, carabiner 1148, with security line 1118 attached thereto, may be secured through hole 1140*a* in peak gusset 1110. In this instance, hole 1140*a* is on the same side of the roof as the roofer and the line of force on peak gusset 1110 is indicated by arrow "A". Alternatively, as shown in FIG. 38*b*, carabiner 1148 may be secured through hole 1140*b* on peak gusset 1110. Hole 140*b* is on the opposite side of peak gusset 1110 from the position of the roofer on the roof. Consequently, the line of force "B" will be directed through the wood of the peak 1120 of the truss 1116. Thus, truss 1116 itself aids in acting as a support for the roofer. The roofer can install sheet members 1122, 1124 and shingles (not shown) in relative safety while attached via security line 1118 to peak gusset 1110. As he moves to the next section of the roof, he can detach carabiner 1148 from peak gusset 1110 on roof truss 1116 and attach the same to a peak gusset installed on another roof truss. Although not illustrated in FIGS. 37-41, an anchoring device may be applied to security line 1118 in place of carabiner 1148 and which is receivable through both holes 1140*a*, 1140*b* on peak gusset 1110.

Figure 41:
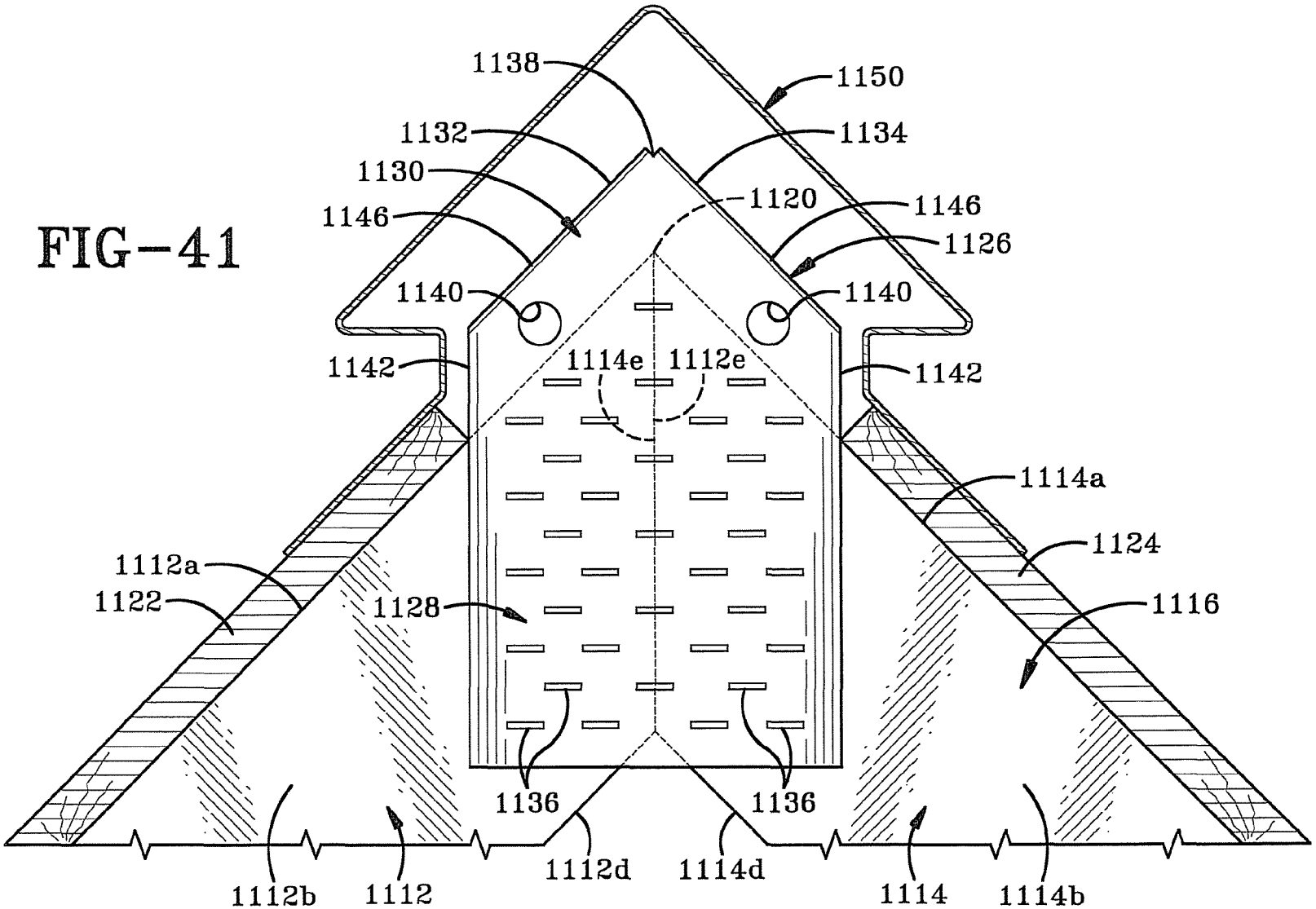
FIG. 41 is a front view of the peak gusset in accordance with the present invention secured to a truss and covered by a ventilation cap.
Figure 42:
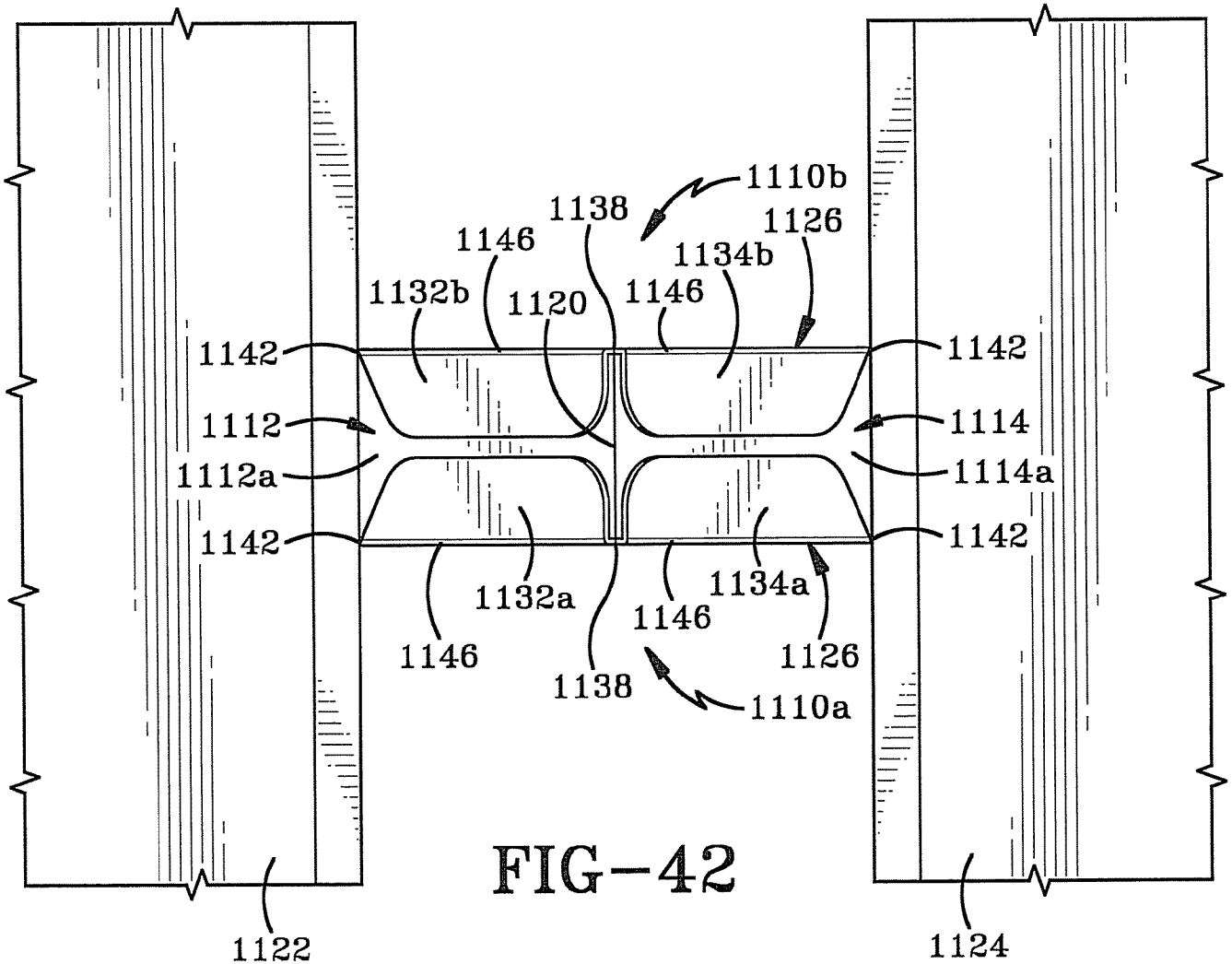
FIG. 42 is a top view of a pair of peak gussets secured on either side of a truss with sheet members extending outwardly away therefrom.

It should be noted that peak gusset 1110 is not removed once the roof is completed. Because holes 1140 are beneath peak 1120 of truss 1116, they are always available for attachment of a carabiner 1148 thereto. Anchor portion 1130 does not need to be cut down in order to install ventilation cap 1150 thereover as shown in FIG. 41. It will be understood that if flaps 1132, 1134 have not been previously bent out of alignment with anchor portion 1130, they may be bent through 900 in order to reduce the height of peak gusset 1110 before ventilation cap 1150 is secured to sheet members 1122, 1124. Ventilation gap 1150 will therefore span the gap between first and second sheet members 1122, 1124 and between a first and a second truss member.

FIGS. 42-46 show that a pair of peak gussets 1110*a*, 1110*b* may be used to secure truss members 1112, 1114 together and to provide an anchoring point for an anchoring system 1152. Peak gussets 1110*a*, 1110*b* are substantially identical to each other. Peak gusset 1110*a* is applied to a first side surface 1112*b*, 1114*b* of truss members 1112, 1114 and peak gusset 1110*b* is applied to the opposing second side surface 1112*c*, 1114*c* thereof. Flaps 1132*a*, 1134*a* on peak gusset 1110*a* may be folded inwardly over truss members 1112, 1114 and flaps 1132*b*, 1134*b* are folded inwardly in the opposite direction. Consequently, first flap 1132*a* on first peak gusset 1110*a* extends toward first flap 1132*b* of second peak gusset 1110*b*, and second flap 1134*a* on first peak gusset 1110*a* extends toward second flap 1134*b* of second peak gusset 1110*b*. Furthermore, the holes 1140 on first peak gusset 1110*a* align with holes in the second peak gusset 1110*b*.

Figure 44:
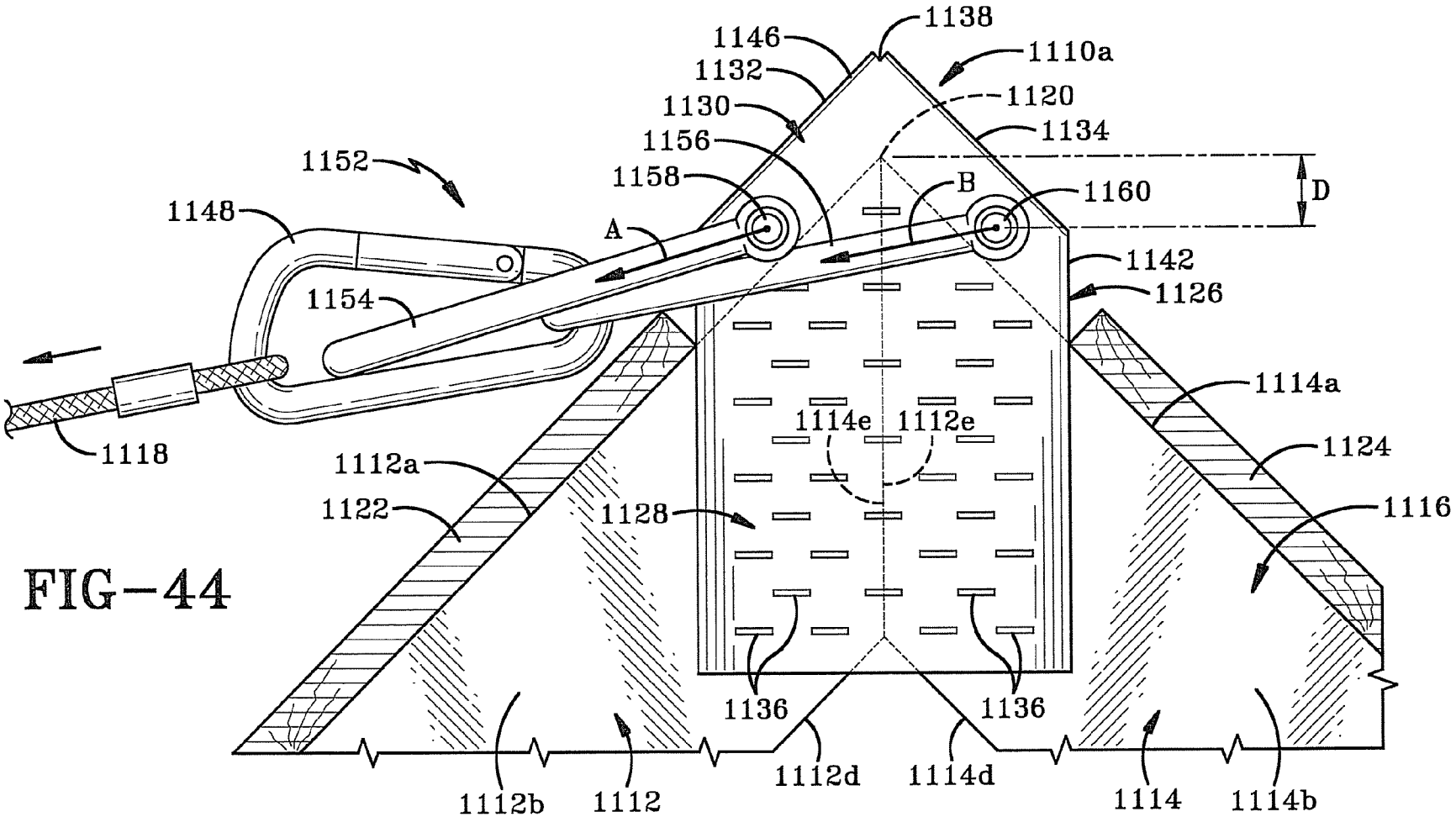
FIG. 44 is front view of the pair of peak gussets of FIG. 42 and showing an anchor system connected thereto.
Figure 45:
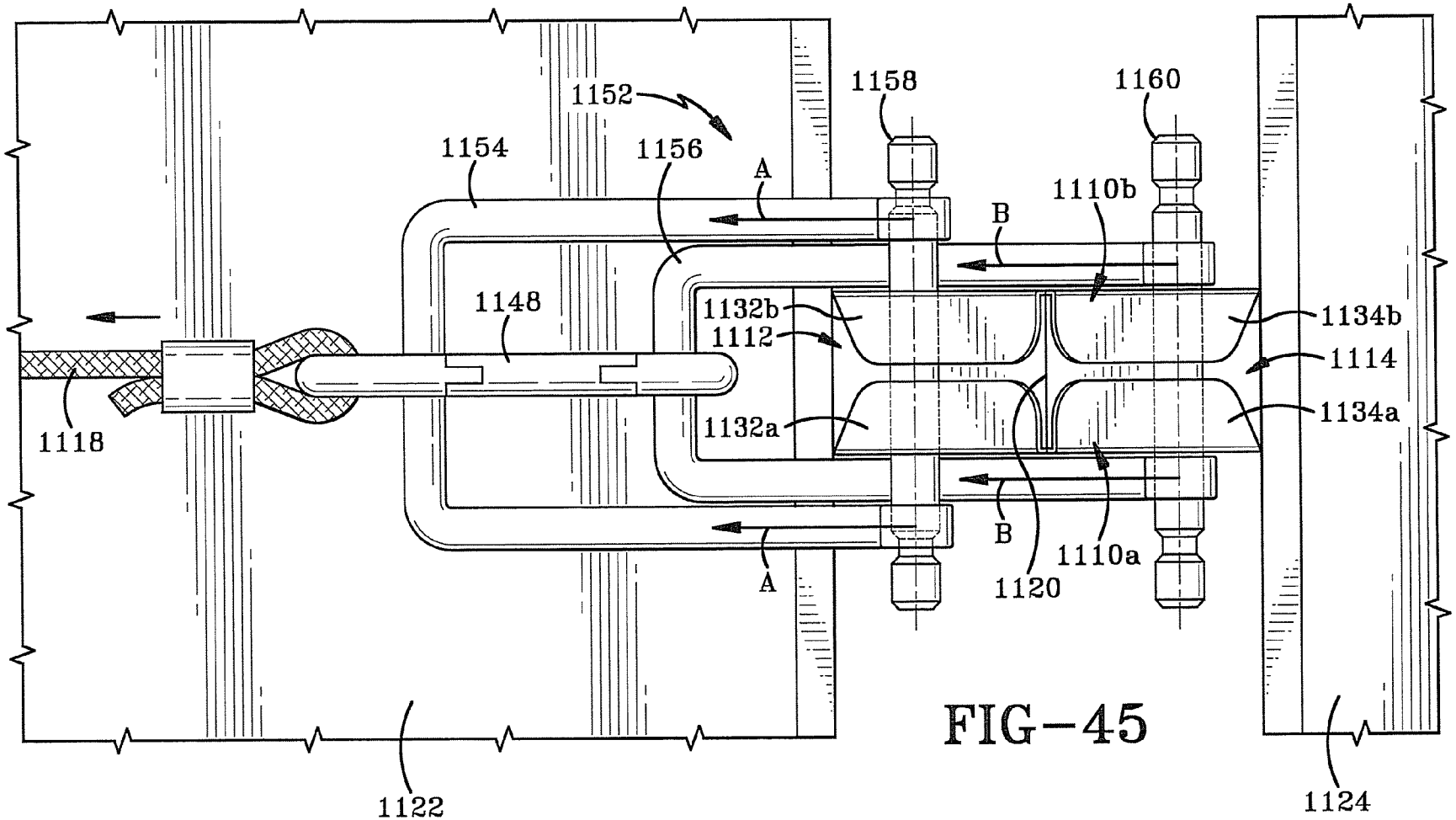
FIG. 45 is a top view of the pair of peak gussets of FIG. 44 showing the anchor system secured thereto.
Figure 46:
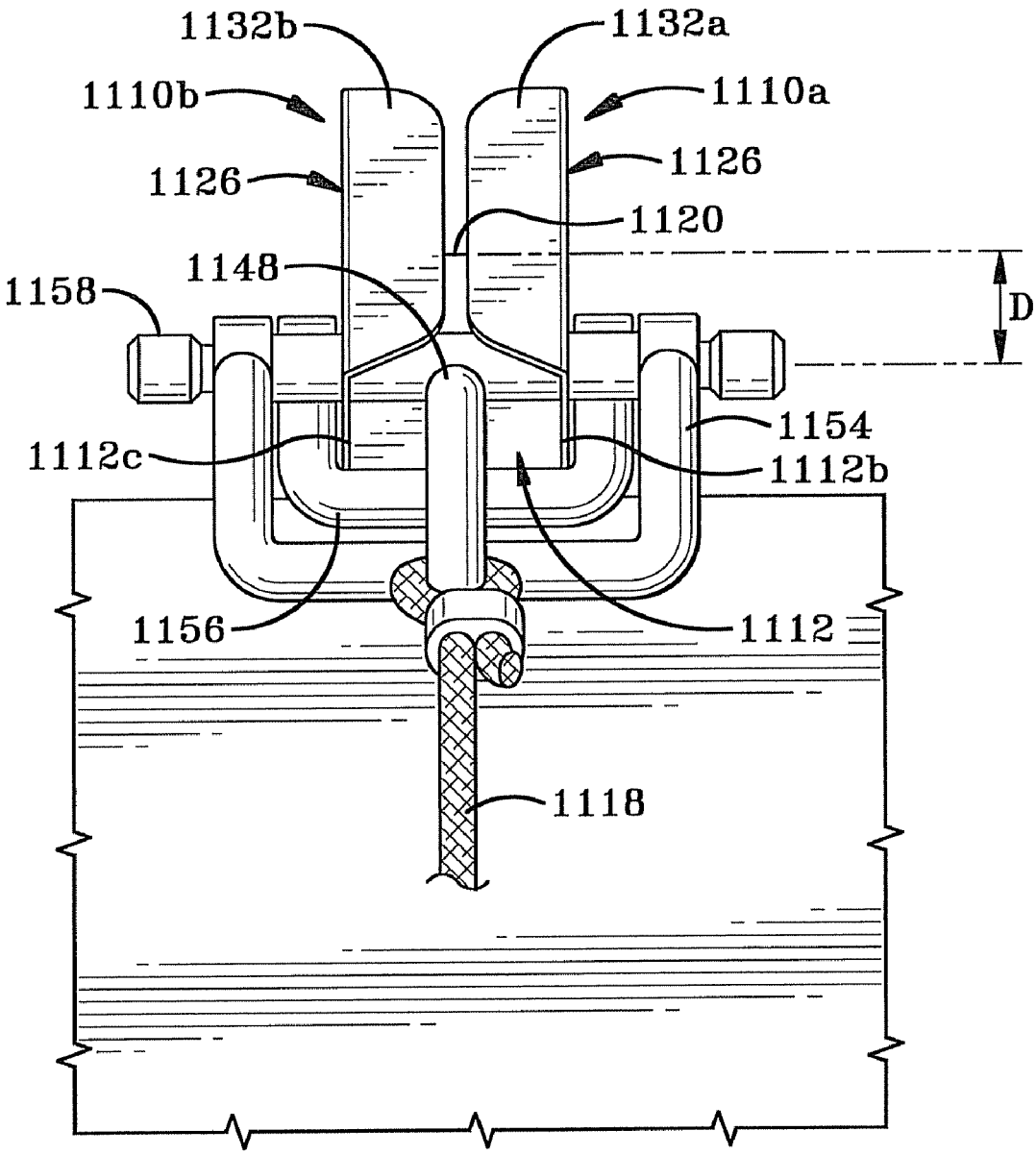
FIG. 46 is a side view of the pair of peak gussets and the anchor system of FIG. 45.

Anchoring system 1152 includes a first connector 1156 and a second connector 1154. A bolt 1160 of first connector 1156 is inserted through a first pair of aligned holes (not numbered) in the first and second peak gussets 1110*a*, 1110*b*. A bolt 1158 of second connector 1154 is inserted through a second pair of aligned holes (not numbered) in the first and second peak gussets 1110*a*, 1110*b*. As shown in FIG. 44, both bolts 1158, 1160 are spaced a distance "D" vertically beneath peak 1120 of truss 1116. A carabiner 1148 engages both of the first and second connectors 1156, 1154 and a security line or cable 1118 is connected to carabiner 1148. As illustrated in FIG. 44, the line of force "B" for the first connector 1156 passes substantially through a portion of the wood of truss 1116 beneath peak 1120, thus strengthening the anchoring system. First connector 1156 may also rest on sheet member 1122 which is secured to the truss member 1112. The support which the peak gussets 1110*a*, 1110*b* can therefore provide is enhanced by the contact with these pieces of sheet material. The presence of two peak gussets 1110*a*, 1110*b* causes the forces from anchoring system 1152 to be more evenly distributed across truss peak 1120.

Figure 47:
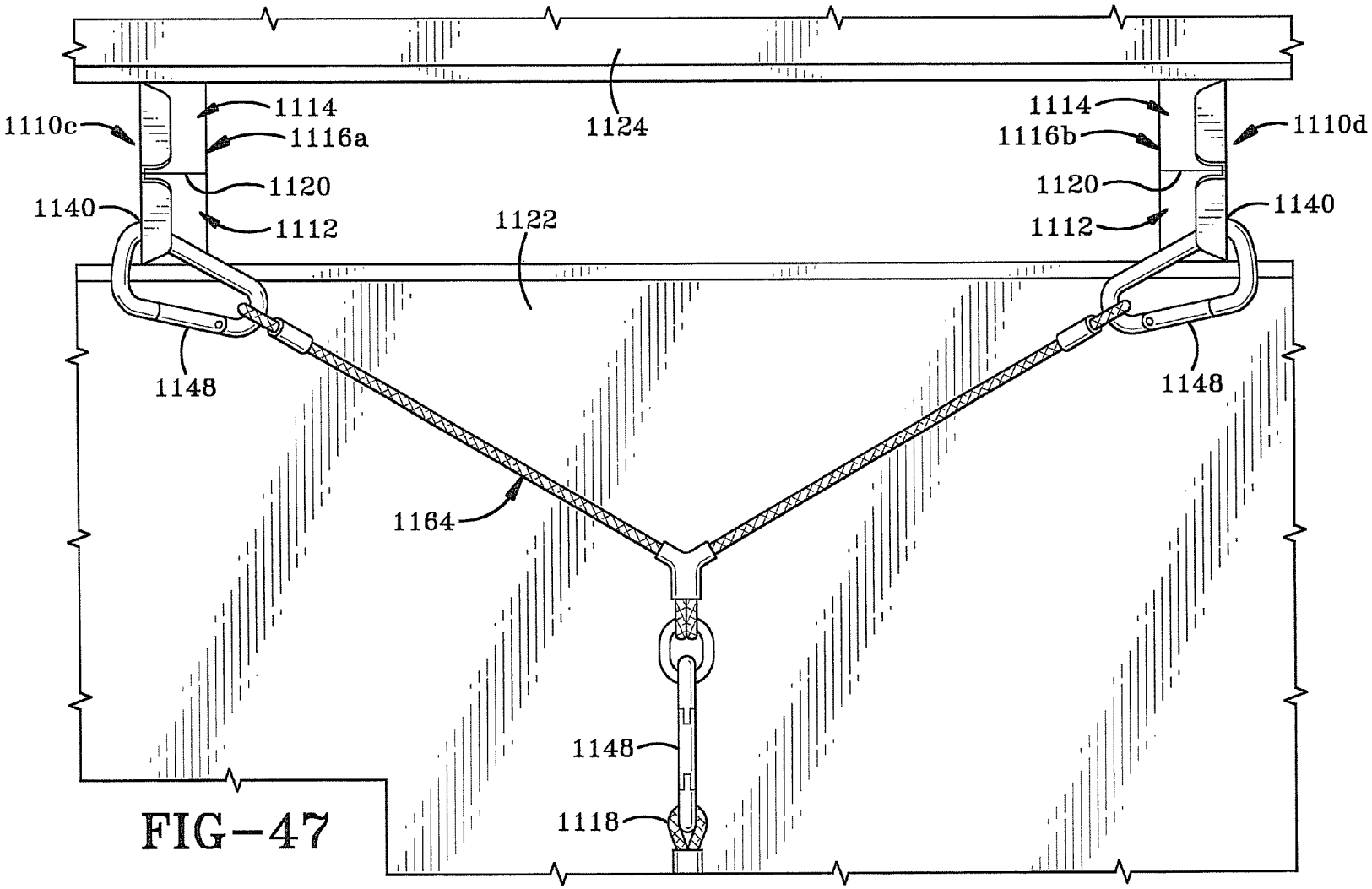
FIG. 47 is a top view of a pair of spaced apart trusses to which peak gussets in accordance with the present invention are secured and showing, a cable type of connector member connecting the spaced apart peak gussets and an anchoring system secured thereto.
Figure 48:
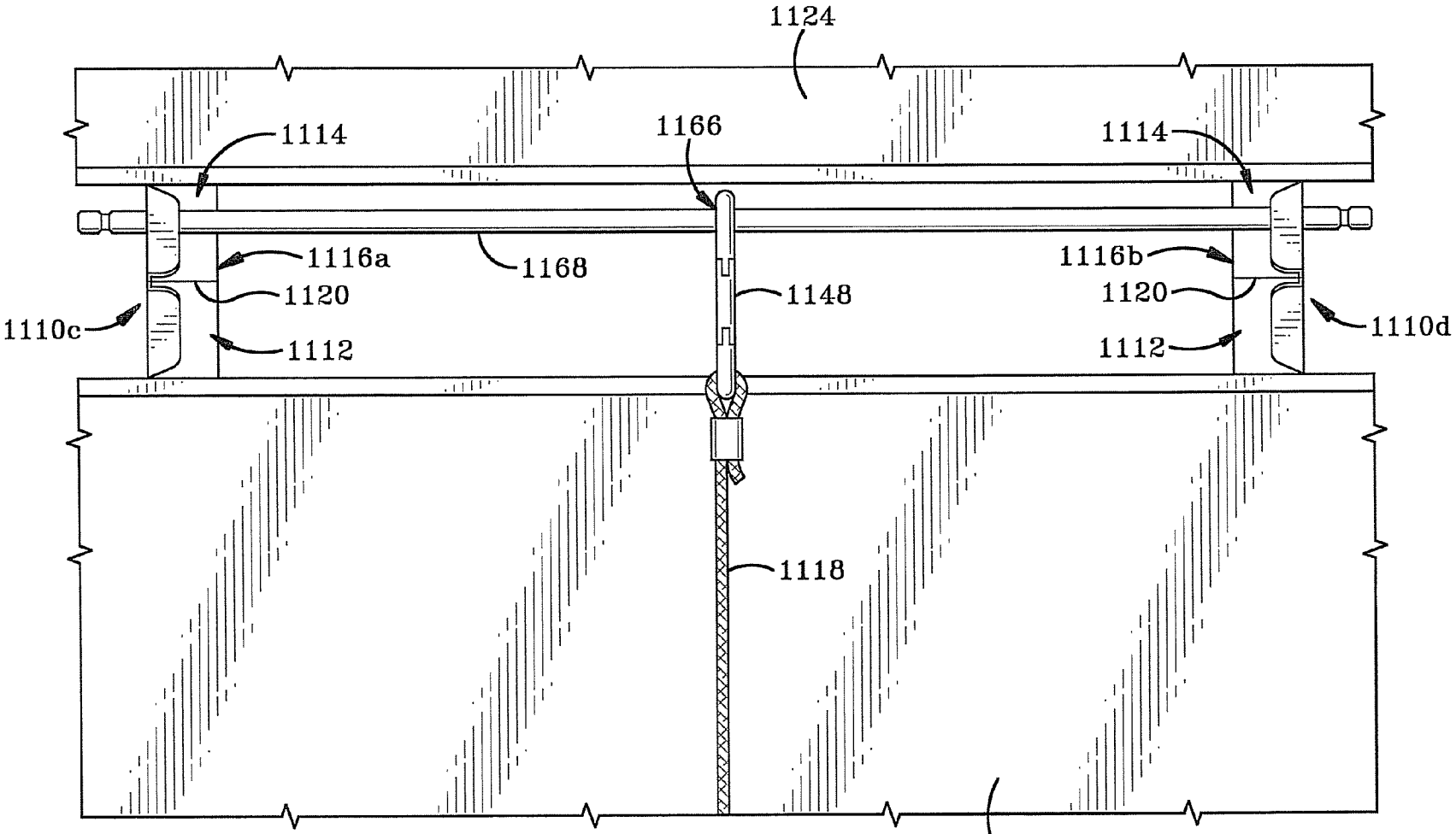
FIG. 48 is a top view of a pair of spaced apart trusses to which peak gussets in accordance with the present invention are secured and showing a rod type of connector member connecting the spaced apart peak gussets and an anchoring system secured thereto.

FIGS. 47 & 48 show a roof anchor system which extends between a first truss 1116*a* and a second truss 1116*b*. Each of the first and second trusses 1116*a*, 1116*b* has a single or double set of peak gussets 1110 secured thereto. In these figures, a single peak gusset 1110*c* is secured to first truss 1116*a* and another single peak gusset 1110*d* is secured to second truss 1116*b*. Preferably the first hole in the first peak gusset 1110*c* aligns with the first hole in the second peak gusset 1110*d*, and the second hole in the first peak gusset 1110*c* aligns with the second hole in the second peak gusset 1110*d*. A connector member extends between the hole in the peak gusset 1110*c* on the first truss 1116*a* and the hole aligned therewith in the peak gusset 1110*d* on the second truss 1116*b*. The connector member may take the form of a Y-cable 1164, such as is shown in FIG. 47 or a rod 1168 shown in FIG. 48. A primary hitch point 1166 is provided along rod 1168 and a carabiner 1148 is secured to hitch point 1166 opposite the side of the roofline on which the roofer is working. Because the holes in peak gussets 1110*c*, 1110*d* are beneath peaks 1120 of first and second trusses 1116*a*, 1116*b*, the connector member, i.e., the cable 1164 or rod 1168, is also positioned beneath peaks 1120. The line of force exerted on the security line 1118 therefore passes through at least a portion of the wood of truss members 1112, 1114.

Referring to FIGS. 49*a*-52 there is shown yet another embodiment of a gusset plate in accordance with the present invention and generally indicated at 1210. Gusset plate 1210 may be used as a roof ridge gusset plate or as an off-ridge plate for securing members of a roof truss together. Gusset plate 1210 also provides a means for anchoring a security line as will be hereinafter described.

Figure 49A:
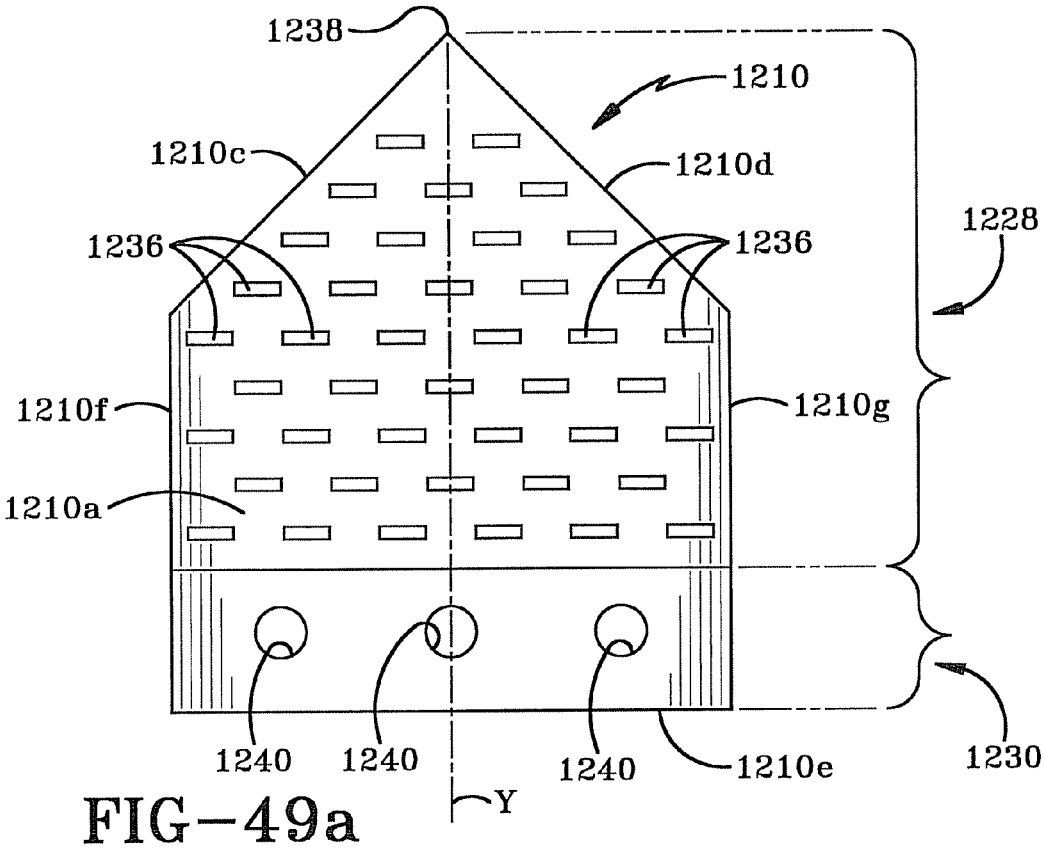
FIG. 49*a* is a front view of yet another embodiment of a gusset plate in accordance with the present invention.
Figure 49B:
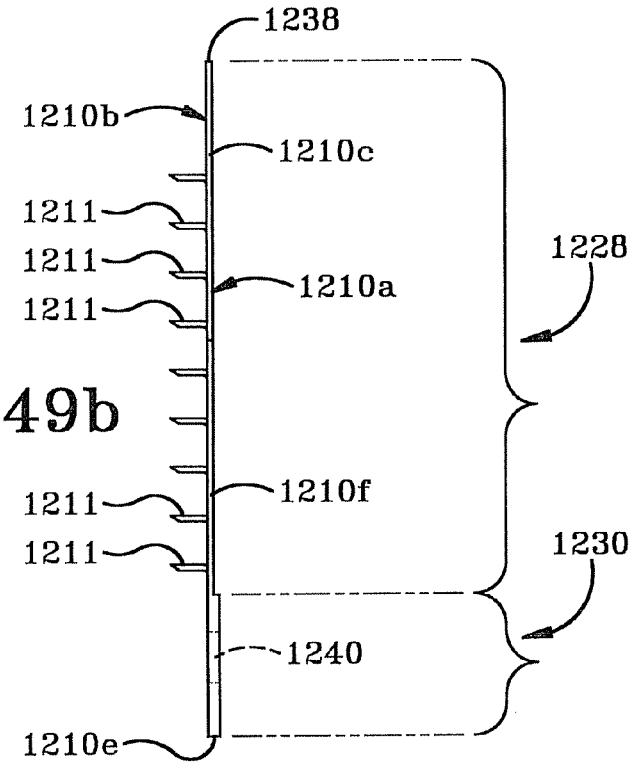
FIG. 49*b* is a side view of the plate of FIG. 49*a;*

Gusset plate 1210 comprises a metal plate that has a front surface 1210*a*, a rear surface 1210*b*, a first edge comprised of first and second sections 1210*c* and 1210*d*, a second edge 1210*e* opposed to the first edge, and first and second sides 1210*f*, 1210*g* that extend between the first and second edges. The first section 1210*c* of the first edge originates at one end of first side 1210*f* and extends outwardly therefrom and at an angle to first side 1210*f*. The second section 1210*d* of the first edge originates at one end of second side 1210*g* and extends outwardly therefrom and at an angle to the second side 1210*g*. The first and second sections 1210*c*, 1210*d* meet at an apex 1238 that is equidistant from each of first and second sides 1210*f*, 1210*g*. Gusset plate 1210 has a longitudinal axis "Y" that runs through apex 1238 and generally along a midline of the plate (FIG. 49*a*).

In accordance with a specific feature of the present invention, gusset plate 1210 includes an attachment region 1228 and an anchor portion 1230 that are generally coplanar with each other. Attachment region 1228 is disposed on the plate adjacent the first and second sections 1210*c*, 1210*d* of the first edge and extends for a distance inwardly therefrom and toward the second edge 1210*e*. Attachment region 1228 includes a plurality of gripping teeth 1211 that project outwardly for a distance from rear surface 1210*b* and generally at right angles thereto. The number 1236 in FIGS. 49*a*-52 indicates regions on front surface 1210*a* that correspond to the regions on the rear surface 1210*b* where teeth 1211 are located. Teeth 1211 are substantially identical to the teeth 13 of the first embodiment of the gusset plate 10 and are shaped so as to be pressed into the wood used to construct a truss 1216. The area of attachment region 1228 adjacent the first edge is substantially triangular in shape and preferably is complementary in shape to the peak of the truss 1216 which it is designed to connect together. The apex of the attachment region is used when the number of teeth required to secure the truss member necessitates the use of that area. It will be understood that gusset plate 1210 may be generally rectangular in shape or may be of any other shape suitable for securing first and second truss members 1212, 1214 together. If gusset plate 1210 is used in an off-ridge situation, for example, the first edge thereof may be configured complementary to the uppermost region of the truss to which it is to be attached.

Anchor portion 1230 of gusset plate 1210 is disposed on the plate adjacent the second edge 1210*e* and extends for a distance inwardly therefrom and toward the first edge. Anchor portion 1230 is integral with attachment region 1228 and preferably is coplanar therewith. Anchor portion 1230 preferably is substantially free of teeth or has minimal numbers of teeth. Alternatively, anchor portion 1230 may include teeth that may or may not be engaged with the wood of truss 1216.

In accordance with yet another specific feature of the present invention, one or more holes are defined in anchor portion 1230. FIG. 49*a* shows three holes 1240*a*, 1240*b*, 1240*c* defined in anchor portion 1230 and spaced a distance apart from each other. Holes 1240*a*-1240*c* are shown horizontally aligned with each other and located and a short distance inwardly from second edge 1210*e*. Holes 1240 may be disposed substantially parallel to the second edge 1210*c* or may be in a staggered pattern relative to each other. Hole 1240*b* is positioned on the midline of gusset plate 1210. Hole 1240*a* is disposed intermediate hole 1240*b* and first side 1210*f*. Hole 1240*c* is disposed intermediate hole 1240*b* and second side 1210*g*.

Although it is not illustrated in FIGS. 49*a*-52, it will be understood that gusset plate 1210 may also be provided with flaps that extend outwardly from the first and second sections 1210*c*, 1210*d* of the first edge. These flaps would be similar in nature and function to those shown in FIG. 37. Gusset plate 1210 may further be provided with a flap that extends outwardly from second edge 1210*e* to provide additional strength to that region of the plate.

As with the previous embodiments, gusset plate 1210 is designed to secure first and second truss members 1212, 1214 together during the construction of a truss 1216. It will be understood that a single gusset plate 1210 may be used for this purpose. Alternatively, a pair of single gusset plates, such as gussets 1210, 1210A may be used for this purpose. First truss member 1212 has an upper surface 1212*a*, a first side surface 1212*b*, a second side surface 1212*c*, a bottom surface 1212*d* and an angled end 1212*e*. Similarly, second truss member 1214 has an upper surface 1214*a*, a first side surface 1214*b*, a second side surface (not shown), a bottom surface 1214*d* and an angled end 1214*e*. The angled ends 1212*e*, 1214*e* are placed in abutting contact with each other. Gusset plate 1210 is then positioned so that its rear surface 1210*b* is positioned on first side surfaces 1212*b*, 1214*b* such that the longitudinal axis "Y" of gusset plate 1210 is aligned along the abutting ends 1212*e*, 1212*f*. Gusset plate 1210 is positioned so that teeth 1211 of attachment region 1228 contact first side surfaces 1212*b*, 1214*b* and the anchor portion 1230 of gusset plate 1210 is disposed substantially free of contact with first side surfaces 1212*b*, 1214*b*. Furthermore, holes 1240*a*-1240*c* of anchor portion 1230 are disposed so that they are disposed between bottom surfaces 1212*d* and 1214*d* of first and second truss members 1212, 1214. Gusset plate 1210 is then pressed inwardly toward first surfaces 1212*b*, 1214*b* such that teeth 1211 bite into the surfaces and thereby secure first and second truss members 1212 and 1214 together. It should also be noted that when gusset plate 1210 is positioned on first and second truss members 1212, 1214, the apex 1238 of gusset plate 1210 is substantially aligned with the peak 1220 of the first and second truss members 1212, 1214.

Figure 50:
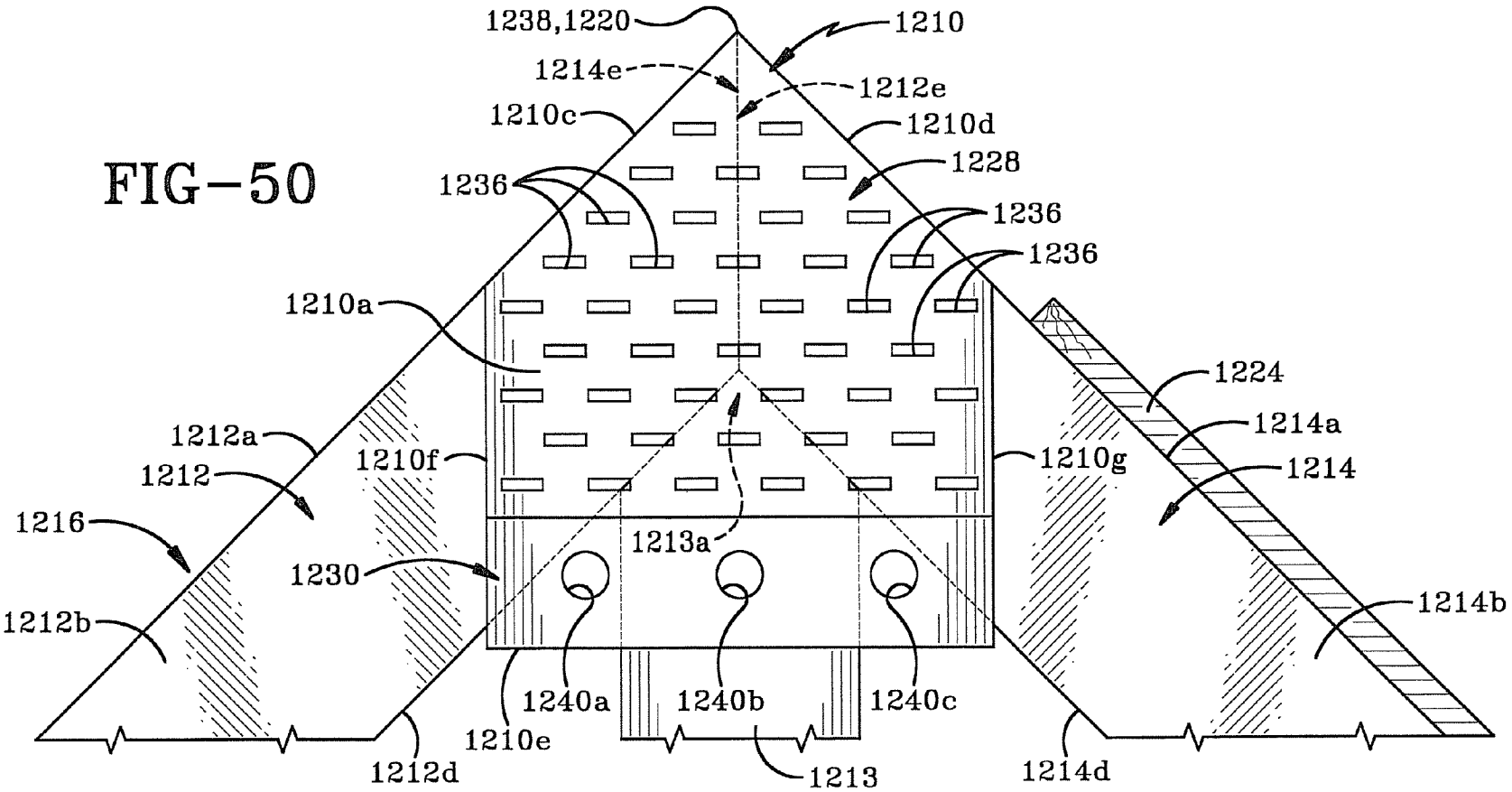
FIG. 50 is a front view of the plate shown attached to a truss and showing sheet material secured to one of the truss members.

Attachment region 1228 does not extend vertically above and laterally outwardly beyond peak 1220 or upper surfaces 1212*a*, 1214*a* of first and second truss members 1212, 1214. Preferably, and as shown in FIG. 50, gusset plate 1210 may also be at least partially attached to an upper end 1213*a* of a king post 1213 that forms part of truss 1216. King post 1213 extends downwardly away from bottom surfaces 1212*d*, 1214*d* of first and second truss members 1212, 1214. When gusset plate 1210 is positioned on first and second truss members 1212, 1214, the anchor portion 1230 is oriented laterally relative to peak 1220 and is disposed vertically downward therefrom. Furthermore, anchor portion 1230 is positioned so that holes 1240*a* and 1240*c* fall intermediate lower surfaces 1212*d*, 1214*d* of first and second truss members 1212, 1214 and on either side of king post 1213. Holes 1240*a* and 1240*c* are therefore available for the securement of a security line to gusset plate 1210 as will be hereinafter described. If truss 1216 does not include a king post 1213, then all three holes 1240*a*, 1240*b* and 1240*c* are available for securement of a security line to gusset plate 1210.

Figure 51:
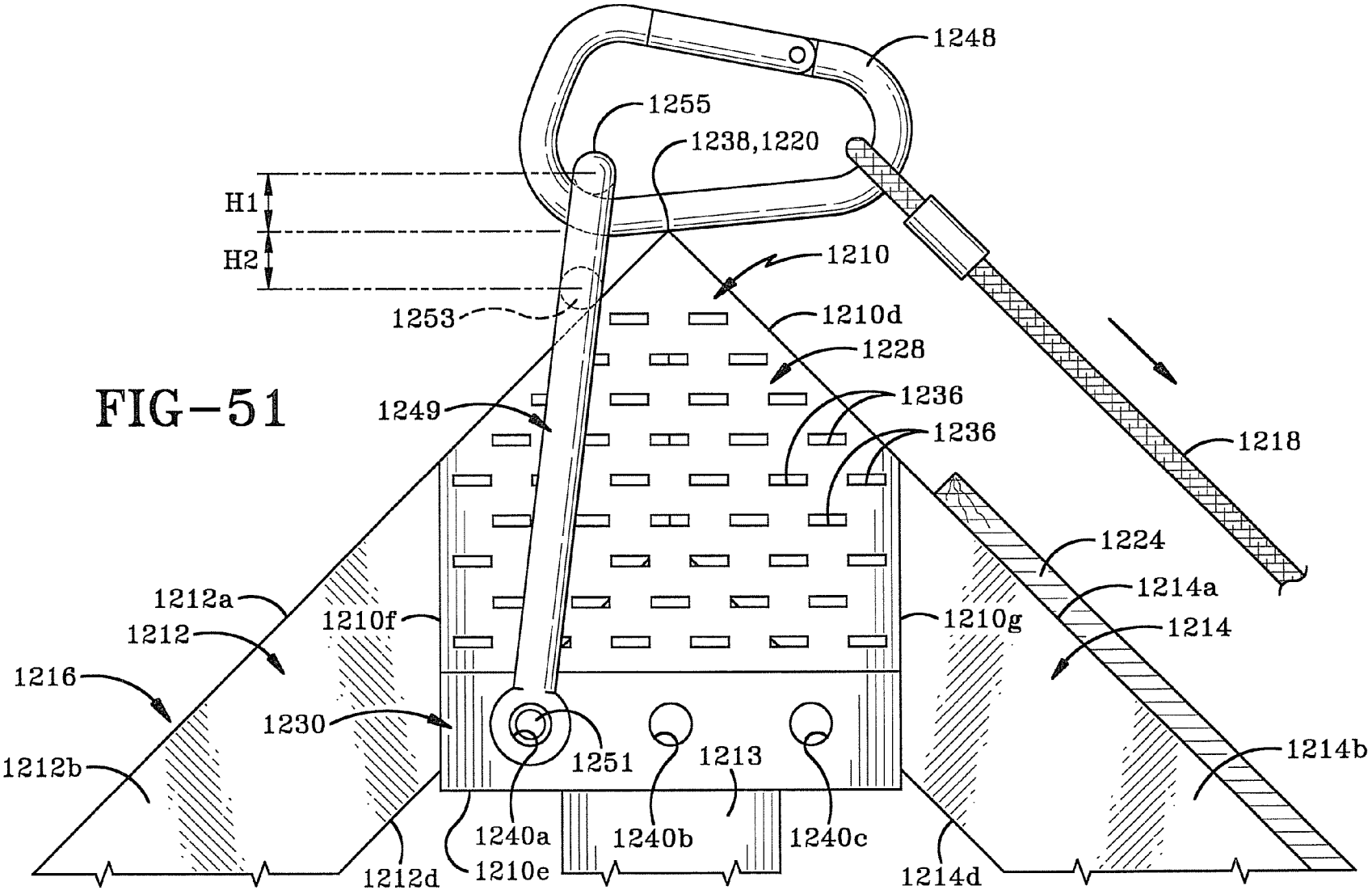
FIG. 51 is a front view of the plate with a shackle engaged therewith and connecting a carabiner and security line thereto.
Figure 52:
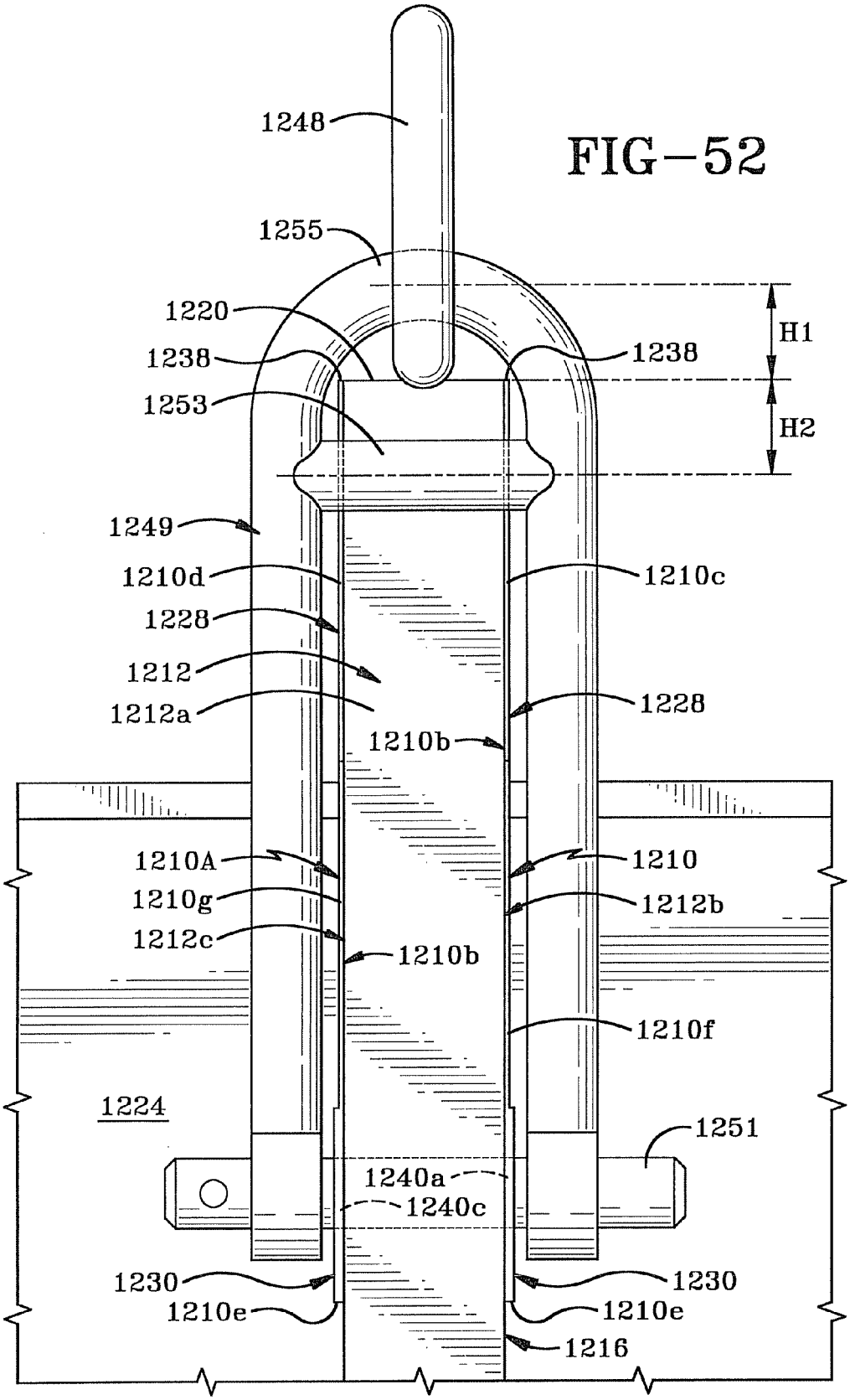
FIG. 52 is a left side view of the truss showing a pair of plates attached to opposing side surfaces of the truss members.

Gusset plate 1210 is designed to be permanently secured to roof truss 1216 at a manufacturing facility and is not removable from truss 1216 once the roof has been constructed. The roof truss 1216 so constructed therefore includes a permanently available anchoring member for attachment of a security line 1218 for a roofer. As was previously described herein, the roof being constructed on a building incorporates a plurality of roof trusses 1216. Each truss 1216 is substantially identical to roof truss 1216 and each truss includes a permanently attached gusset plate 1210. Once all of the roof trusses 1216 are mounted to the wall framing for the building, planar sheets of material, such as plywood sheets, may be secured thereto and shingles applied thereover. FIG. 51 illustrates a first sheet member 1224 secured to upper surface 1214*a* of second truss member 1214. Sheet member 1224 does not extend all of the way to peak 1220 but, instead, has an upper edge that terminates a short distance away therefrom. Consequently, when sheet members are secured to each of the upper surfaces 1212*a*, 1214*a* of first and second truss members 1212, 1214, a gap is formed between the upper edges of those sheet members. The gap allows hot air trapped in the roof to escape from beneath the sheet members. Gusset plate 1210 is of a width between its first and second sides 1210*f*, 1210*g* such that it is suitable to be received in the gap between the upper edges of the sheet members 1224. Preferably, as illustrated in FIG. 52, a second, substantially identical gusset plate 1210A is installed on the second side surface 1212*c* of first truss member 1212 and the second side surface (not shown) of second truss member 1214. Second gusset plate 1210A is positioned so that the holes 1240 in second gusset plate 1210A align with the holes 1240 in the gusset plate 1210.

FIGS. 50-52 illustrate the use of gusset plate 1210 secured to first and second truss members 1212, 1214 at the peak of a roof truss. It will be understood, however, that a gusset plate or a pair of gusset plates in accordance with the present invention could be utilized to secure other regions of the truss together and could be utilized as part of a security line anchoring system in this alternative location. Furthermore, a gusset plate or a pair of gusset plates in accordance with the present invention may be secured at any location on any one of the members of the truss, even on only one of the first and second truss members if the gusset plate(s) are simply to be utilized as a part of a security line anchoring system. In other words, the gusset plate or pair of gusset plates do not need to be utilized to secure two truss members together. The single plate or pair of plates may, instead, simply be attached to one member of a truss and in any location on the truss in order to provide a secure connection for a security line as part of an anchoring system. In any of these abovementioned locations, at least an area of the anchor portion of the gusset plate, or gusset plates, extends beneath the truss member(s) with which the plate(s) are engaged. Furthermore, one or more holes for connecting the security line to the gusset plate(s) are disposed in this area of the anchor portion.

FIGS. 51 & 52 illustrate an anchoring system for a roofer in accordance with the present invention. The anchoring system includes gusset plate 1210, a D-shaped shackle 1249, a carabiner 1248 and a security line 1218. It will be understood that a single gusset plate 1210 may be utilized in the anchoring system in accordance with the present invention or a pair of gusset plates 1210, 1210A may be utilized without departing from the spirit of the present invention. FIG. 52 shows shackle 1249 secured to two gusset plates 1210, 1210A, but it will be understood that only a single gusset plate 1210 may be provided on truss 1216 and that shackle 1249 would be therefore secured to that single gusset 1210. Alternatively, two gusset plates 1210, 1210A may be provided on truss 1216 and shackle may be engaged with only one of those gussets 1210, 1210A. The following description relates to shackle 1249 being secured to a pair of gussets 1210, 1210A.

When a roofer is ready to roof the building, he attaches a first connector (not shown) to a first end (not shown) of a security line 1218 to a harness that he is wearing. He then engages the "D-shaped" shackle 1249 with gusset plates 1210 and 1210A. Shackle 1249 includes a pin 1251, a crossbar 1251 and a top end 1255. Pin 1251 is inserted through aligned holes 1240*a*, 1240*c* in peak gussets 1210, 1210A, respectively. If holes 1240 are formed in a staggered pattern in the anchor regions of peak gussets 1210, 1210A, then the roofer is able to select the optimum D-shackle pin location for correct alignment of crossbar 1251 with the upper surface 1212*a* of first truss member 1212. Preferably, shackle 1249 is engaged with the aligned holes 1240*a* that are on the opposite side of the peak 1220 from where the roofer intends to work. Carabiner 1248 at the second end of security line 1218 is secured to shackle 1249 between top end 1255 and crossbar 1253.

It should be noted that top end 1255 of shackle preferably is disposed at a first height H1 above the peak 1220 of truss 1216 and apex 1238 of gusset plate 1210 when the anchoring system is in use. Furthermore, crossbar 1253 of shackle 1249 is disposed at a second height H2 below the peak 1220 and apex 1238 when the anchoring system is in use. Preferably, H1 is one inch above peak 1220 and H2 is one inch below peak 1220. This arrangement enables crossbar 1253 of shackle 1249 to securely contact the wood of truss 1216 while positioning top end 1255 of shackle 1249 at a height suitable to permit carabiner 1248 and security line 1218 to cross the peak 1220. It may prove advantageous for attachment region 1228 to be substantially triangular in shape and complementary to the shape of peak 1220, as gusset plate 1210 may thereby substantially prevent the wood of truss 1216 at peak 1220 from splitting because of the forces brought to bear thereon by crossbar 1253 of shackle 1249.

In the instance illustrated in FIGS. 51 and 52, holes 1240*a* are on the opposite side of the roof from the roofer and, consequently, the lines of force on gusset plate 1210 are directed through the wood of peak 1220 and additionally through the wood of king post 1213. Thus, truss 1216 and king post 1213 aid in acting as a support for the roofer. The roofer can therefore install sheet member 1224 and shingles (not shown) in relative safety while attached via security line 1218 to gusset plate 1210. As the roofer moves to the next section of the roof, he will detach shackle 1249 and carabiner 1248 from gusset plates 1210, 1210A and reattach the same to a similar pair of gusset plates installed on another roof truss. It should be noted that gusset plates 1210, 1210A remain in place and are not removed once the roof is completed.

When the roofer is going to apply sheet material to first truss member 1212, he disengages shackle 1249 from hole 1240*a* in anchor portion 1230 of plate and engages first pin 1251 in hole 1240*c* of gusset plate 1210. When shackle 1249 is so engaged, crossbar 1253 will engage upper surface 1214*a* of second truss member 1214 and carabiner 1248 and security line 1218 will clear peak 1220 and apex 1238 and extend downwardly over upper surface 1212*a* of first truss member 1212. Once again, crossbar 1253 will engage upper surface 1214*a* of second truss member 1214 approximately 1 inch below the peak 1220 and top end 1255 of shackle 1249 will be disposed approximate 1 inch above the peak.

It will be understood that if truss member 1216 includes king post 1213, then the third hole 1240*b* will not be utilized to secure shackle 1249 and carabiner 1248 thereto. However, if the king post in not provided on a truss, then the third hole 1240*b* is also available for securing the shackle 1249 thereto.

One of the advantages of utilizing gusset plate 1210 is that the positioning of the holes 1240 below the lower surfaces 1212*d*, 1214*d* of truss member 1216 and some distance beneath peak 1220, causes the force applied to the shackle 1249 when supporting a person on the security line 1218 to be passed into both the king post 1213 and truss member 1216. The security line is therefore more firmly anchored than in previously known systems.

It will be understood that while the uppermost portion of gusset plate 1210 (comprised of first and second sections 1210*c*, 1210*d* and adjacent regions of first and second sides 1210*f*, 1210*g*) has been shown and described as being generally triangular in shape, this uppermost portion may be shaped differently without departing from the spirit of the present invention. For instance, the gusset plate may be substantially square or rectangular in overall shape—i.e. the first edge comprised of first and second sections 1210*c*, 1210 may be a straight edge so that the gusset plate has a flat top. Alternatively, the first edge may be irregular in shape or may be arcuate in shape. Thus, it will be understood that the shape of the top of the gusset plate may not be important in all applications. But, in some circumstances, use of a gusset plate as shown and described with a triangular upper region may be necessary to achieve adequate load capacity to secure the first and second truss members 1212, 1214 together.

Although the present invention has been described above in detail, the same is by way of illustration and example only and is not to be taken as a limitation on the present invention. It is understood that many variations of the illustrated invention are possible without departing from the scope of the present invention. Accordingly, the scope and content of the present invention are to be defined only by the terms of the appended claims.

The invention claimed is:

1. A roof ridge or off-ridge gusset plate, for securing a safety line for a roofer comprising:

a plate member having a front surface, a rear surface, a first edge, a second edge and first and second sides extending between the first and second edges; wherein the first edge of the plate member comprises a first section and a second section; where the first section originates at one end of the first side and extends outwardly away therefrom at an angle to the first side; and the second section originates at one end of the second side and extends outwardly away therefrom at an angle to the second side; and wherein the first and second sections extend toward each other and meet at an apex; and wherein the plate member includes:

an attachment region disposed adjacent the first edge and extending inwardly toward the second edge, and an area of the attachment region adjacent the first edge is substantially triangular in shape;

an attachment mechanism provided in the attachment region, the attachment mechanism extending outwardly away from the rear surface of the plate member;

an anchor portion disposed adjacent the second edge and extending inwardly toward the attachment region; and a first hole defined in the anchor portion; the first hole extending from the front surface through to the rear surface of the plate member.

2. The gusset plate as defined in claim 1, wherein the attachment region and the anchor portion are substantially coplanar.

3. The gusset plate as defined in claim 1, wherein the attachment mechanism comprises a plurality of teeth that extend outwardly away from the rear surface and substantially at right angles thereto.

4. The gusset plate as defined in claim 3, wherein the anchor portion is substantially free of teeth.

5. The gusset plate as defined in claim 3, wherein the anchor portion is includes some of the plurality of teeth.

6. The gusset plate as defined in claim 1, wherein the anchor portion further defines a second hole therein, where the second hole is spaced a distance away from the first hole and extends from the front surface of the plate member through to the rear surface thereof.

7. The gusset plate as defined in claim 6, wherein the first and second holes are one of aligned with each other, disposed substantially parallel to the second edge of the plate member, staggered relative to each other and staggered relative to the second edge of the plate member.

8. The gusset plate as defined in claim 1, wherein the substantially triangular shaped area of the attachment region is adapted to be complementary shaped to a peak of a roof truss.

9. A roof truss comprising:

a first truss member having an upper surface, a lower surface, opposed first and second side surfaces and an angled end;

a second truss member having an upper surface, a lower surface, opposed first and second side surfaces and an angled end;

a plate member engaged with at least one of the first and second truss members; wherein the plate member has a front surface, a rear surface, a first edge, a second edge, and first and second sides extending between the first and second edges; and the plate member includes:

an attachment region disposed adjacent the first edge and extending inwardly toward the second edge;

an attachment mechanism provided in the attachment region, the attachment mechanism extending outwardly away from the rear surface of the plate member; and an anchor portion disposed adjacent the second edge of the plate member and extending inwardly toward the attachment region; and wherein the attachment mechanism secures the plate member to the at least one of the first and second truss members such that an area of the anchor portion of the plate member extends downwardly beyond the lower surface of the at least one of the first and second truss members.

10. The roof truss as defined in claim 9, wherein the anchor portion of the plate member further defines a first hole therein, and said first hole is disposed in the area of the anchor portion that extends below the lower surface of the at least one of the first and second truss members.

11. The roof truss as defined in claim 10, wherein the angled ends of the first and second truss members are disposed in abutting contact with each other such that the first and second members form a substantially V-shaped member with the angled ends thereof disposed at a peak of the V-shaped member; and wherein the attachment mechanism secures the plate member to a portion of each of the first surfaces of the first and second truss members at the peak, and the area of the anchor portion that defines the first hole extends below the lower surfaces of the first and second truss members and vertically beneath the peak.

12. The roof truss of claim 11, further comprising a second hole defined in the plate member a spaced distance from the first hole.

13. The roof truss of claim 11, wherein the anchor portion of the plate member extends laterally below the peak and is one substantially free of teeth and includes teeth.

14. The roof truss of claim 9, wherein the attachment mechanism comprises a plurality of teeth which extend outwardly away from the rear surface of the plate member.

15. The roof truss of claim 9, wherein substantially none of the plate member extends outwardly beyond the upper surfaces of the first and second truss members.

16. The roof truss of claim 9, wherein the first edge of the plate member comprises a first section and a second section; where the first section originates at one end of the first side of the plate member and extends outwardly away therefrom and at an angle to the first side; and the second section originates at one end of the second side of the plate member and extends outwardly away therefrom and at an angle to the second side; and the first and second sections extend toward each other and meet at an apex; whereby an area of the attachment region adjacent the first edge is substantially triangular in shape.

17. The roof truss of claim 9, wherein the plate member is permanently secured to the roof truss by the attachment mechanism.

18. The roof truss as defined in claim 9, further comprising:

a second plate member engaged with the at least one of the first and second truss members; wherein the second plate member has a front surface, a rear surface, a first edge, a second edge, and first and second sides extending between the first and second edges; and the second plate member includes:

an attachment region disposed adjacent the first edge and extending inwardly toward the second edge;

an attachment mechanism provided in the attachment region, the attachment mechanism extending outwardly away from the rear surface of the second plate member; and an anchor portion disposed adjacent the second edge of the second plate member and extending inwardly toward the attachment region thereof; and wherein the attachment mechanism secures the second plate member to the at least one of the first and second truss members opposite the plate member such that at least an area of the anchor portion of the second plate member extends outwardly beyond the lower surface of the at least one of the first and second truss members.

19. An anchoring system for a roofer comprising:

a plate member having a front surface, a rear surface, a first edge, an opposing second edge and first and second sides extending between the first and second edges; and wherein the plate member includes:

an attachment region disposed adjacent the first edge and extending inwardly toward the second edge;

an attachment mechanism provided in the attachment region, the attachment mechanism extending outwardly away from the rear surface of the plate member and being adapted to secure the plate member to a roof truss;

an anchor portion disposed adjacent the second edge and extending inwardly toward the attachment region;

a first hole defined in the anchor portion; the first hole extending from the front surface through to the rear surface of the plate member; and a security line detachably connectable to the plate member; wherein the security line includes:

a length of cord having a first end and a second end;

a first connector engaged with the first end of the cord and being detachably receivable through the first hole in the anchor portion of the plate member;

a second connector engaged with the second end of the cord and being adapted to engage a harness worn by the roofer.

20. The anchoring system for a roofer as defined in claim 19, wherein the first connector is a D-shaped shackle having:

a first pin that is receivable through the first hole in the anchor portion;

a crossbar adapted to abut a portion of a roof truss when the security system is in use; said crossbar being disposed in the shackle a spaced distance away from the first pin an upper end disposed a spaced distance away from the crossbar.

21. The anchoring system as defined in claim 20, wherein the plate member is adapted to be secured to a peak of a roof truss, and wherein the distance in the shackle between the crossbar and the first pin is such that when the security system is in use, the crossbar will engage the roof truss around one inch below the peak thereof; and the distance in the shackle between the upper end and the crossbar is such that the upper end is disposed about one inch above the peak of the roof truss.

22. The anchoring system for a roofer as defined in claim 21, wherein the anchor portion defines a second hole and the second hole is spaced a distance from the first hole; and wherein the anchor portion extends downwardly below the peak when the plate member is engaged therewith; and the first connector is detachably engageable with the first hole when the roofer is working on one side of the peak and is detachably engageable with the second hole when the roofer is working on the other side of the peak.

23. The anchoring system as defined in claim 19, further comprising:

a second plate member having a front surface, a rear surface, a first edge, an opposing second edge and first and second sides extending between the first and second edges; and wherein the second plate member includes:

an attachment region disposed adjacent the first edge and extending inwardly toward the second edge;

an attachment mechanism provided in the attachment region, the attachment mechanism extending outwardly away from the rear surface of the second plate member and being adapted to secure the second plate member to the roof truss in a position opposite the plate member;

an anchor portion disposed adjacent the second edge and extending inwardly toward the attachment region;

a first hole defined in the anchor portion; the first hole extending from the front surface through to the rear surface of the second plate member; and wherein the first hole in the second plate member is alignable with the first hole in the plate member when the plate member and second plate member are engaged with the roof truss; and wherein the first connector is detachably receivable through the aligned first holes in the anchor portions of the plate member and second plate member.

* * * * *